US006957617B2

(12) United States Patent
Hori

(10) Patent No.: US 6,957,617 B2
(45) Date of Patent: Oct. 25, 2005

(54) THREAD GUIDE THREADING APPARATUS AND SEWING MACHINE PROVIDED THEREWITH

(75) Inventor: Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 165 days.

(21) Appl. No.: 10/631,717

(22) Filed: Aug. 1, 2003

(65) Prior Publication Data

US 2004/0089211 A1 May 13, 2004

(30) Foreign Application Priority Data

Aug. 1, 2002 (JP) ..... 2002-225245
Aug. 1, 2002 (JP) ..... 2002-225246

(51) Int. Cl.[7] ..... D05B 22/00; D05B 87/00
(52) U.S. Cl. ..... 112/302; 112/225
(58) Field of Search ..... 112/302, 259, 254, 112/224, 225, 226, 241; 242/364.4; 223/99

(56) References Cited

U.S. PATENT DOCUMENTS 2,919,667 A * 1/1960 Koenig ..... 112/302
4,183,313 A * 1/1980 Odermann et al. ..... 112/302
4,241,678 A * 12/1980 Tullman ..... 112/225
4,351,495 A * 9/1982 Lindstrom et al. ..... 242/365.4
4,977,842 A * 12/1990 Fukao et al. ..... 112/199
5,069,150 A * 12/1991 Ogawa ..... 112/241
5,386,791 A * 2/1995 Sato et al. ..... 112/302
6,701,858 B2 * 3/2004 Wacker ..... 112/225

* cited by examiner

*Primary Examiner*—Ismael Izaguirre
(74) *Attorney, Agent, or Firm*—Oliff & Berridge PLC

(57) ABSTRACT

A threading apparatus for threading a thread guide of a sewing machine includes a moving member, a pivot arm, and a hook member pivotally mounted on the moving member and coupled to the pivot arm so as to be operated in synchronization with the pivot arm. The hook member has a threading hook and performs a first rocking switching the hook member from a standby position where the threading hook is not threaded to an operating position, based on action of an operating force upon rotation of the pivot arm. The hook member further performs a sliding movement in which the hook member is slid from the operating position together with the pivot arm and the moving member to thread the thread guide and a second rocking in which the hook member is rocked to be returned to the standby position after having threaded the thread guide.

20 Claims, 31 Drawing Sheets

THREAD GUIDE THREADING APPARATUS AND SEWING MACHINE PROVIDED THEREWITH

BACKGROUND OF THE INVENTION

1. Field of the Invention

This invention relates to a thread guide threading apparatus for threading a thread guide of a needle bar provided in a lower portion of a sewing head and a sewing machine provided with the thread guide threading apparatus.

2. Description of the Related Art

In conventional sewing machines, a needle bar is often provided with a thread guide guiding a thread extending from a needle thread take-up lever through a needle eye, along a needle bar. The thread guide needs to be threaded before the thread is passed through the eye of the needle supported on the lower end of the needle bar. In the conventional sewing machines, however, threading the thread guide is manually carried out by the user. On the other hand, the thread guide is often formed with a thread guard which is open only at one side in order that the thread may be prevented from easily disengaging from the thread guide during sewing.

In the preparation for sewing, however, the thread guide is sometimes close to the sewing head depending on a position of the needle bar stopped. In such a case, the needle bar needs to be located near an uppermost position in order that the thread may be passed through the needle eye, whether or not the sewing machine is provided with a threading apparatus. Accordingly, when the thread guide is threaded, a thread guide provided above the needle is located near the sewing head or the thread guide is located close to the sewing head when the needle bar is moved upward so that cloth is put into or taken out of a spaced defined between the needle and the sewing bed.

Under the foregoing condition where the thread guide is close to the sewing head, the operator has a difficulty in viewing the thread guide and it is difficult for the operator to thread the thread guide since a space between the thread guide and the sewing head is too narrow. Furthermore, even when the sewing machine is constructed so that the thread guide is automatically threaded after the sewing machine has been threaded, the thread guard of the thread guide is open only at one side in many cases, whereupon there is a possibility that the thread guide may not be threaded reliably.

SUMMARY OF THE INVENTION

Therefore, an object of the present invention is to provide a thread guide threading apparatus which can thread the thread guide of the needle bar automatically and reliably and a sewing machine provided with the thread guide threading apparatus.

The present invention provides a thread guide threading apparatus threading a thread guide provided in a lower part of a sewing machine head. The apparatus comprises a moving member mounted on the sewing machine head so as to be slid, a pivot arm pivotally mounted on the moving member so as to be caused to pivot and so as to slide the moving member when an operating force is applied thereto, and a hook member. The hook member is pivotally mounted on the moving member and coupled to the pivot arm so as to be operated in synchronization with the pivot arm. The hook member has a threading hook and performs a first rocking switching the hook member from a standby position where the threading hook is not threaded to an operating position, based on action of an operating force upon pivoting of the pivot arm. The hook member further performs a sliding movement in which the hook member is slid from the operating position together with the pivot arm and the moving member to thread the thread guide and a second rocking in which the hook member is rocked to be returned to the standby position after having threaded the thread guide.

The thread is engaged with the threading hook by the first rocking when the operating force acts on the pivot arm. The thread engaged with the threading hook is pulled toward the thread guide side by the sliding movement, whereby the thread guide is threaded. Finally, the second rocking disengages the thread from the threading hook. Thus, the thread guide can automatically be threaded reliably by a three-step operation of the hook member.

The invention provides another thread guide threading apparatus threading a thread guide provided in a lower part of a sewing machine head and having an open end an inner end, the apparatus comprising an operating force applying member receiving an external operating force, and a hook member having a threading hook and moved by the operating force received by the operating force applying member between a standby position where the threading hook is not threaded and an operating position where the threading hook can be threaded. The movement of the hook member includes a first movement in which the hook member is switched from the standby position to the operating position, a second movement in which the hook member is moved a predetermined distance so that the thread caught on the threading hook by the first movement is moved from the open end of the thread guide to the inner end side of the thread guide, and a third movement in which the hook member is switched from the operating position to the standby position.

When the operating force acting on the operating force applying member is transmitted to the hook member, the hook member is switched from the standby position to the operating position by the first movement, so that the thread engages the threading hook. The thread caught on the threading hook is moved from the open end of the thread guide to the inner end side by the second movement. Finally, by the third movement, the threading hook is disengaged from the thread. Thus, since the thread can be caught on the thread guide while the thread is being moved from the open end of the thread guide to the inner end side, the thread guide can reliably be threaded.

The invention provides further another thread guide threading apparatus for use in a sewing machine which includes a thread cassette detachably attached to a cassette mount and a thread guide provided below a needle bar supporting a sewing needle. The threading apparatus comprises a hook member having a threading hook and moved between a standby position where the thread drawn from the thread cassette is not caught on the threading hook and an operating position where the threading hook is threaded, the hook member being switched between the standby position and the operating position, whereby the thread is caught on the thread guide, and an operating force applying member applying an operating force for switching the hook member between the standby position and the operating position in synchronization with attachment of the thread cassette.

The thread guide is automatically threaded in synchronization with attachment of the thread cassette. This can avoid the operator's manually threading the thread guide after the thread has been passed through the needle eye and accordingly, the working efficiency can be improved.

The invention provides a still another thread guide threading apparatus for use in a sewing machine which includes a first thread guide provided at a lower portion of a needle bar supporting a sewing needle and a second thread guide away from the first thread guide by a predetermined distance. The apparatus comprises a hook member having a threading hook and being moved between a standby position where the threading hook is not threaded and an operating position where the threading hook is allowed to be threaded, the hook member being switched between the standby position and the operating position thereby to thread the first and second thread guides, and an operating force applying member applying an operating force for switching the hook member between the standby position and the operating position.

When the operating force for operating the hook member is applied to the operating force applying member, the operating force is transmitted to the hook member so that the hook member is switched between the standby position and the operating position. In this case, the thread is caught not only on the first thread guide below the needle bar but also on the second thread guide away from the first thread guide by the predetermined distance. Consequently, since an individual work for threading the second thread guide is avoided, the working efficiency can be improved.

BRIEF DESCRIPTION OF THE DRAWINGS

Other objects, features and advantages of the present invention will become clear upon reviewing the following description of embodiment, made with reference to the accompanying drawings, in which.

DETAILED DESCRIPTION OF THE INVENTION

One embodiment of the present invention will be described with reference to the accompanying drawings. In the embodiment, the invention is applied to a household sewing machine in which a thread is automatically passed through a needle eye in synchronization with attachment of a thread cassette.

Figure 1:
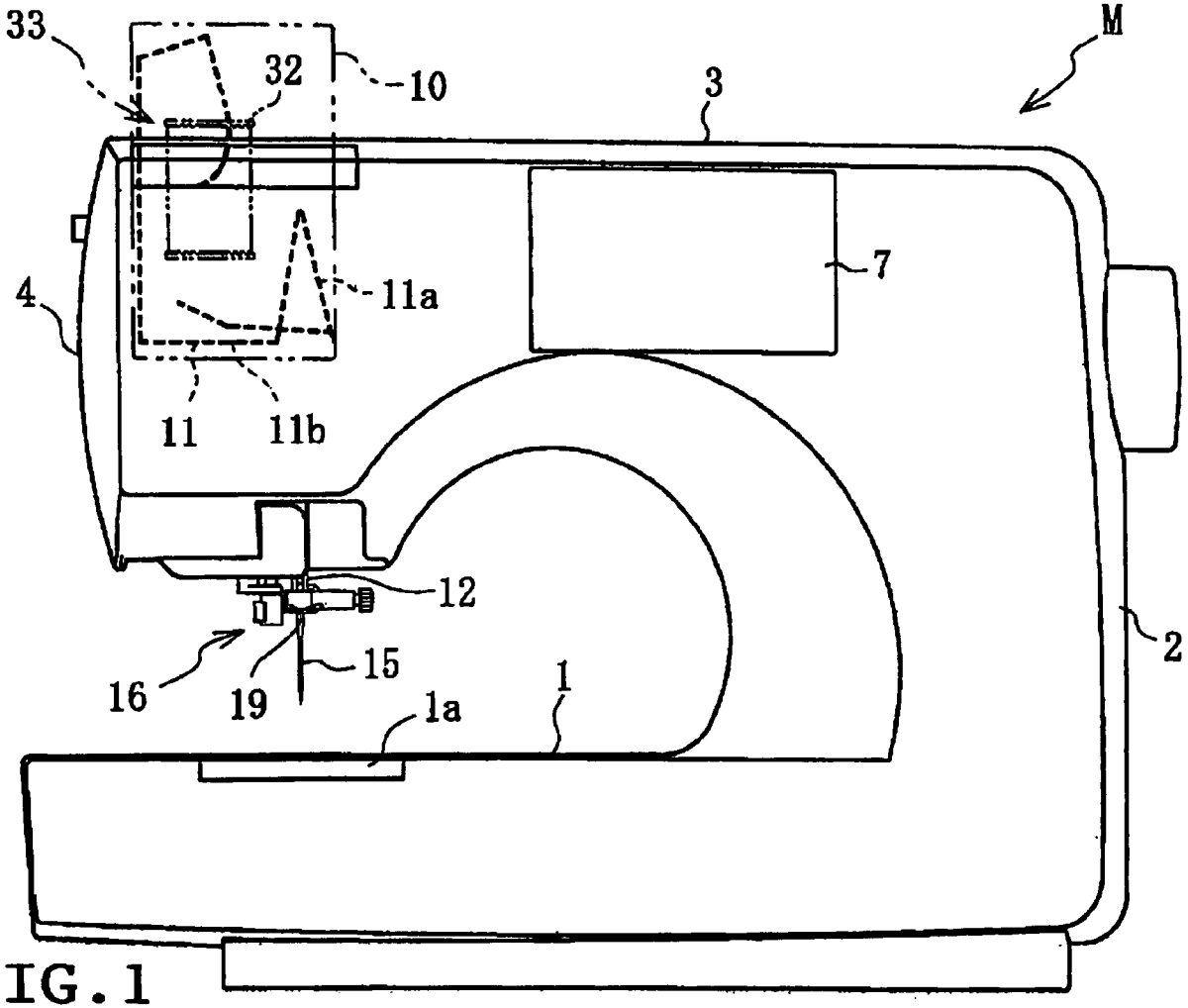
FIG. 1 is a front view of a sewing machine in accordance with one embodiment of the present invention.
Figure 2:
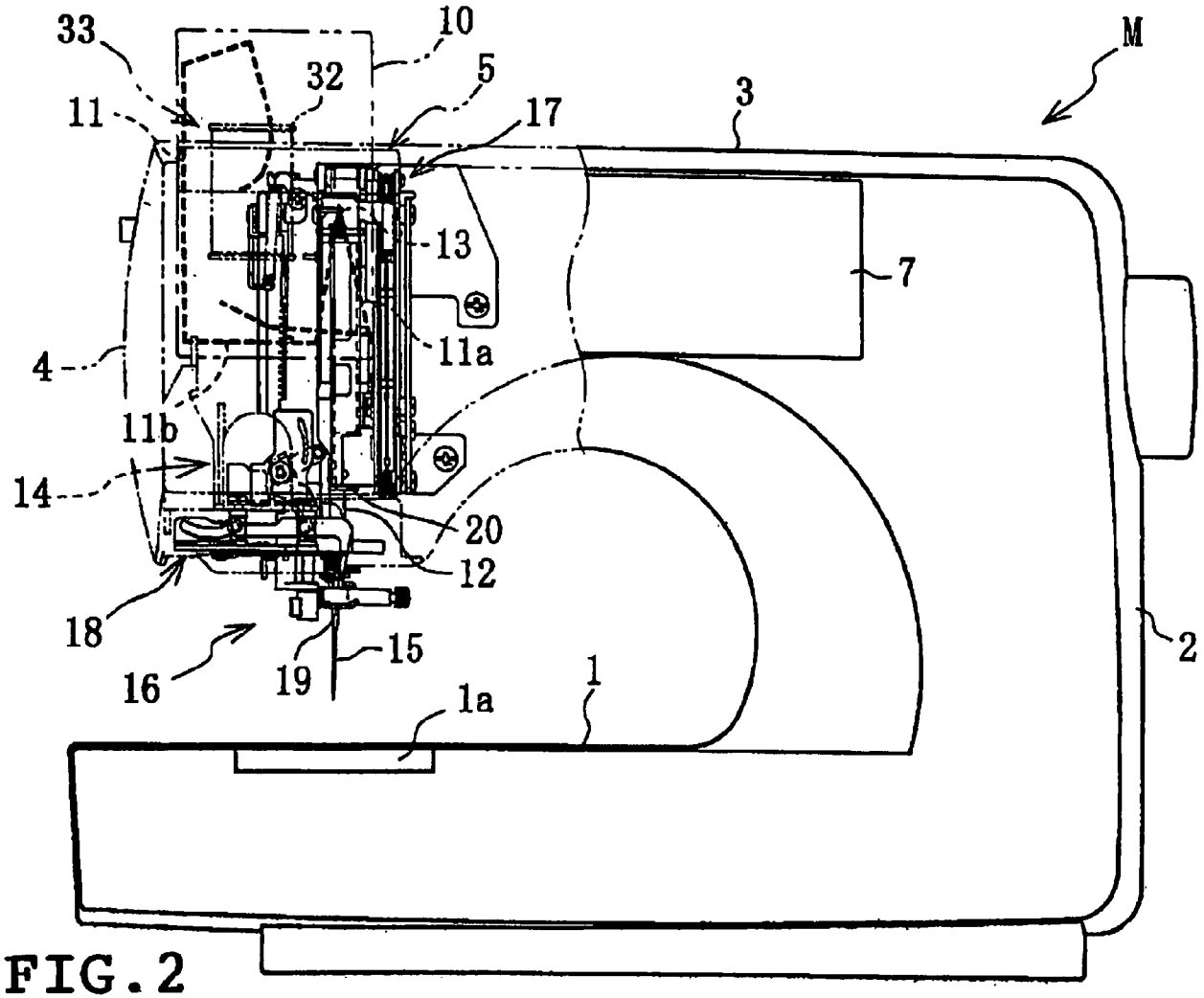
FIG. 2 is a partially cut-out front view of the sewing machine.

Referring to FIGS. 1 and 2, the household sewing machine M includes a sewing bed 1 having a horizontal plane, a pillar 2 standing from a right end of the bed 1, a sewing arm 3 extending leftward from an upper end of the pillar 2 so as to be opposed along the bed 1, and a machine head 4 located at a left end of the arm 3. The head 4 is provided with a cassette mount 5 to which a thread cassette 10 is detachably attached. A thread drawn from the thread cassette 10 attached to the cassette mount 5 serves as a needle thread. The arm 3 or the head 4 thereof includes operation switches (not shown) such as a sewing start switch, sewing finish switch, etc. The arm 3 further includes a liquid crystal display 7.

Figure 3:
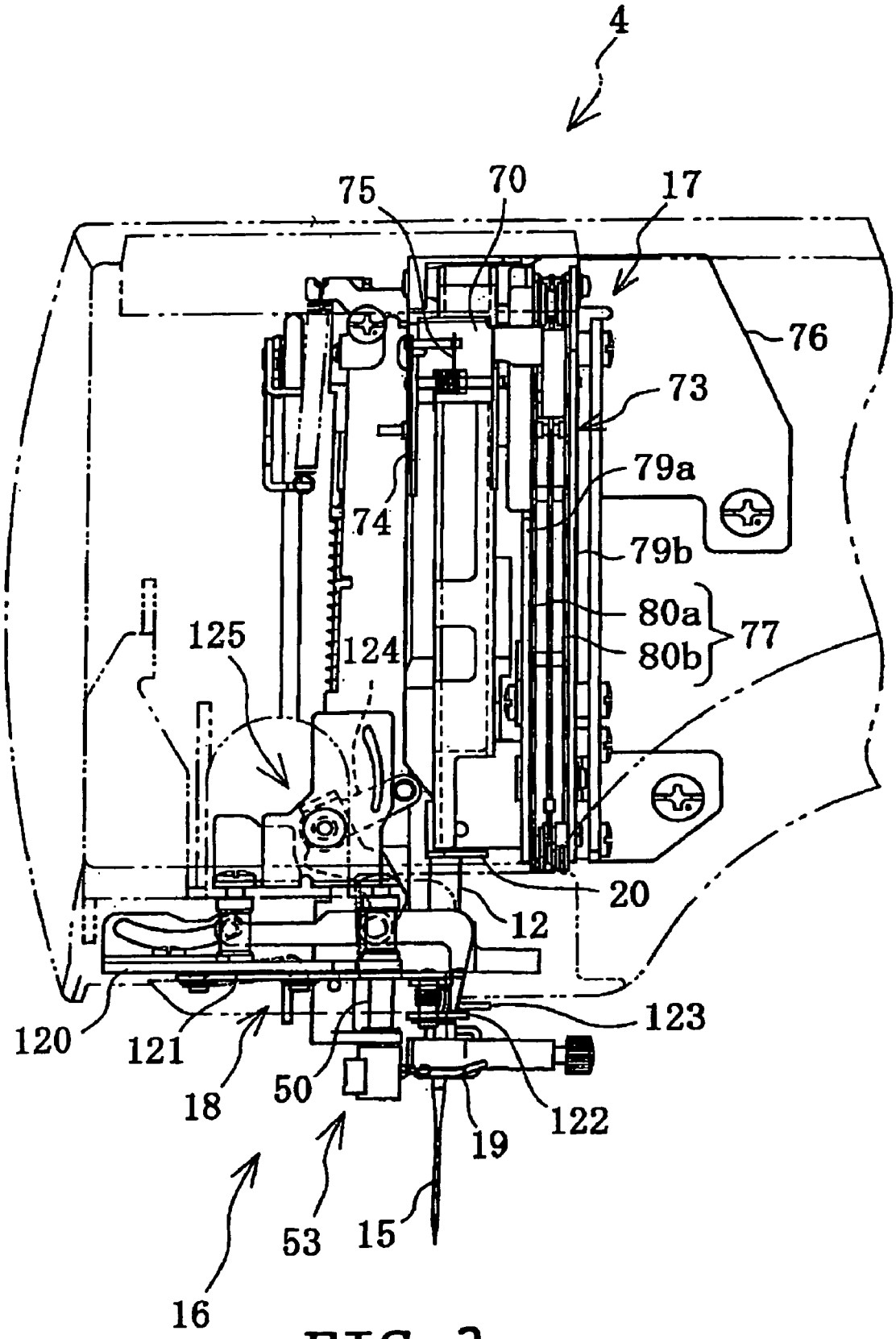
FIG. 3 is a partial enlarged view of the thread holding mechanism.
Figure 4:
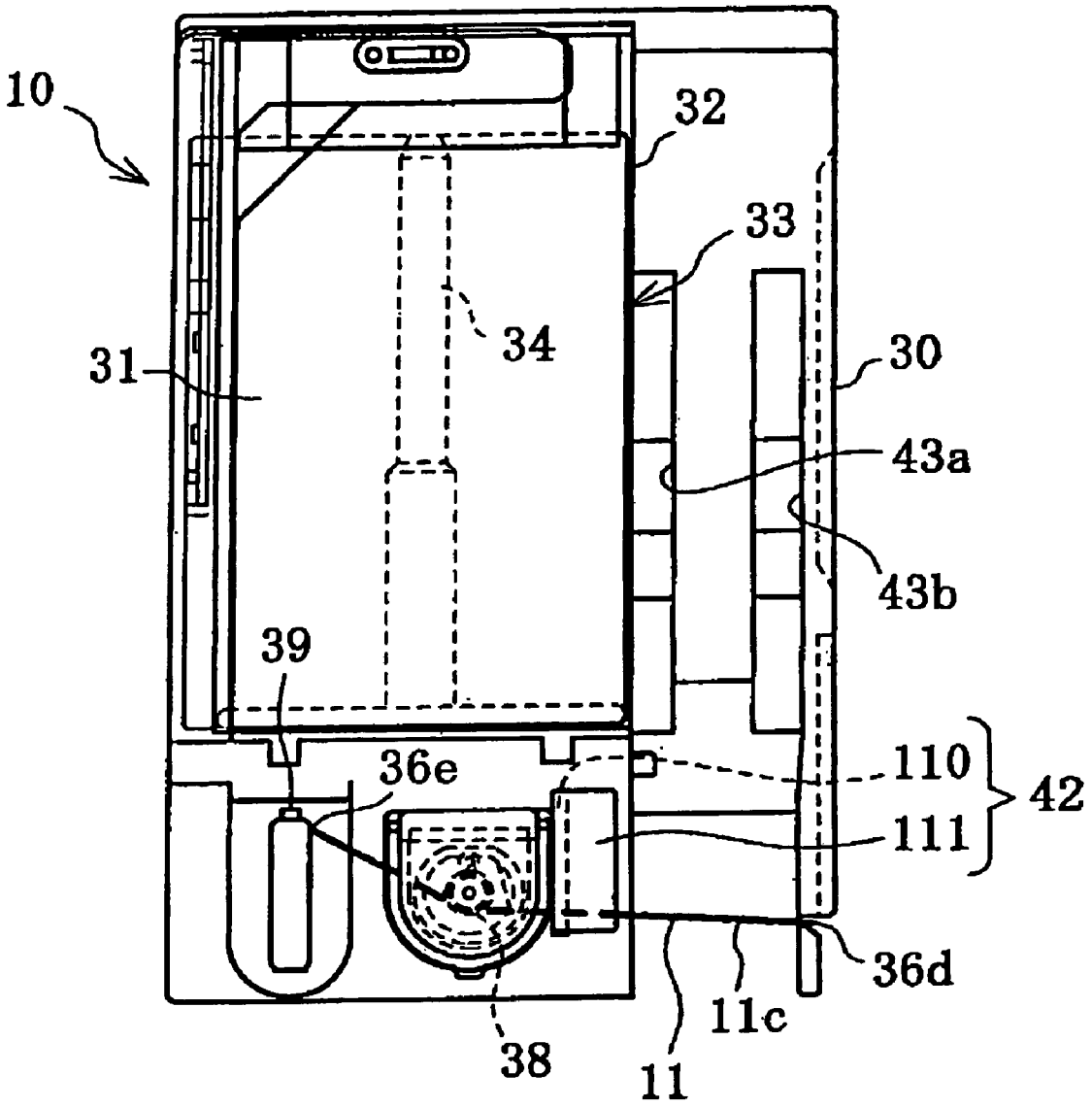
FIG. 4 is a front view of a thread cassette.
Figure 10:
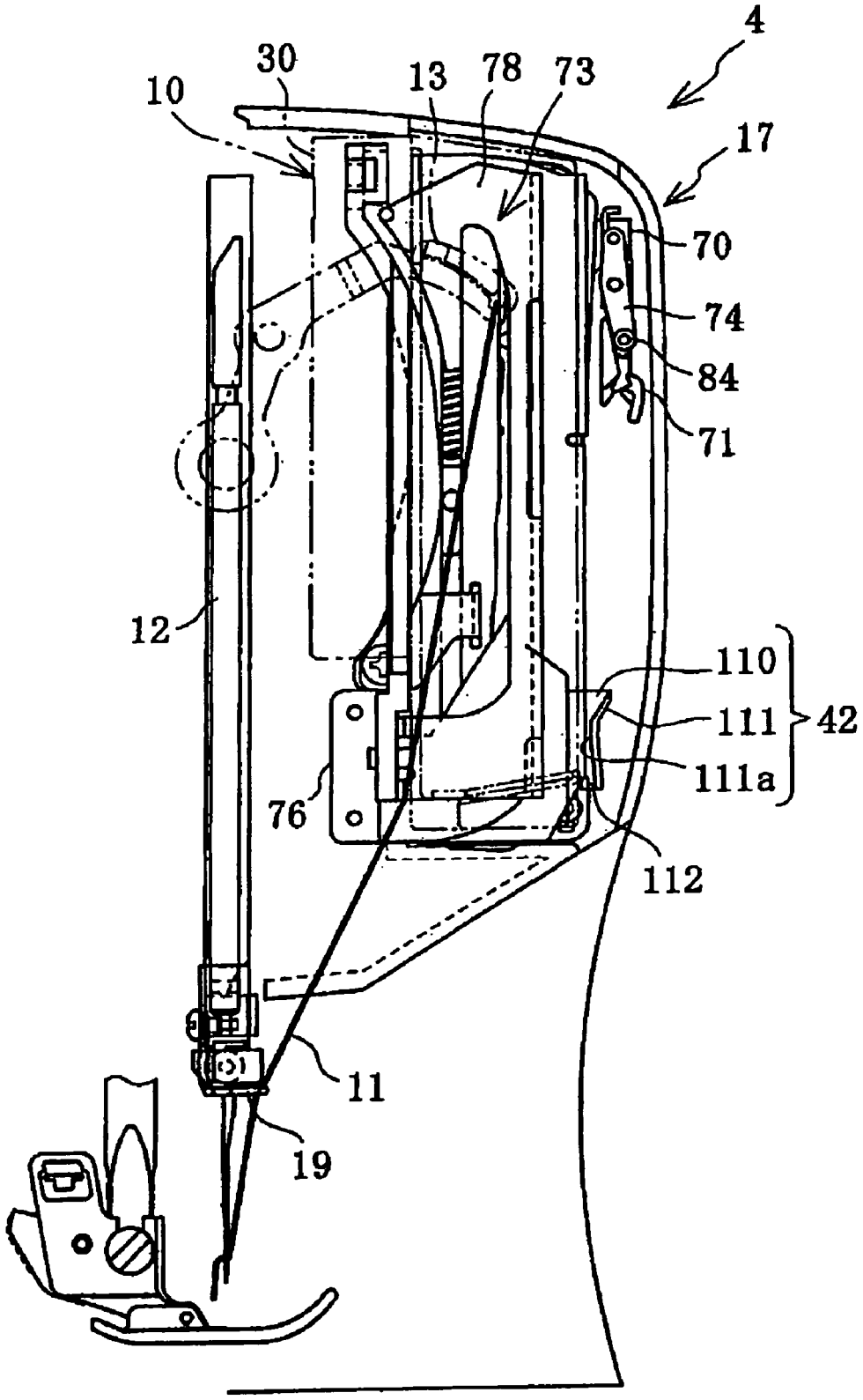
FIG. 10 is a side view of the sewing machine head when the threading operation has been completed.

Referring now to FIGS. 2 and 3, in the head 4 are provided a needle bar 12, a needle thread take-up lever 13 (see FIG. 10) and a thread tensioning mechanism 14 adjusting a thread tension of the needle thread drawn from the thread cassette 10. In the head 4 are further provided a threading mechanism 16 for automatically passing the needle thread 12 through an eye 15*a* of the needle 15 supported on the needle bar 12 when the thread cassette 10 is attached to the cassette mount 5, a principal portion of a thread holding mechanism 17 holding the needle thread 11 near the needle eye 15*a* for the threading by the threading mechanism 16, a thread guide threading mechanism 18 automatically threading a first thread guide 19 mounted on a lower end of the needle bar 12 and a second thread guide 20 provided near the lower end of the head 4.

The two thread guides 19 and 20 are separated away from each other in the lower portion of the head 4 by a predetermined distance. The thread guides 19 and 20 have thread guards 19*a* and 20*a* on which the needle thread 11 is caught, respectively (see FIGS. 24 to 27). The thread guards 19*a* and 20*a* are open substantially in the same direction (rightward) and substantially horizontal. In the head 4 are further provided a needle bar vertically moving mechanism for vertically moving the needle bar 12, a needle bar rocking mechanism for rocking the needle bar 12, and a needle thread take-up lever driving mechanism for vertically rocking the needle thread take-up lever 13.

The needle thread 11 drawn from the thread cassette 10 attached to the cassette mount 5 is caught, from above, on a thread tension shaft (not shown) between a pair of thread tension discs of the thread tensioning mechanism 14. The needle thread 11 extending downstream from the thread tension shaft is further guided to be caught on the needle thread take-up lever 13. Furthermore, the needle thread 11 extending downstream from the needle thread take-up lever 13 is passed through the needle eye 15*a* by the threading mechanism 16 after having been held near the needle eye 15*a* by the thread holding mechanism 17. The needle thread 11 is then caught on the thread guides 19 and 20 by the thread guide threading mechanism 18, whereupon the needle thread is set for the sewing operation. Each of the threading mechanism 16, thread holding mechanism 17 and thread guide threading mechanism 18 is automatically operated in synchronization with attachment of the thread cassette 10.

On the other hand, the bed 1 is provided with a bobbin mount (not shown) to which a bobbin is detachably attached. A thread extending from the bobbin serves as a bobbin thread. The bed 1 is further provided with a shuttle mechanism (not shown). When the needle and bobbin threads are set for the sewing operation and a sewing machine motor (not shown) is then driven, the needle bar 12 is vertically moved by the needle bar vertically moving mechanism. The shuttle mechanism is driven in synchronization with the vertical movement of the needle bar 12 so that the needle thread 11 is caught by the shuttle mechanism near the needle 15 lowered below a needle plate 1*a* of the bed 1, whereupon the needle and bobbin threads are entangled to be formed into stitches.

Figure 5:
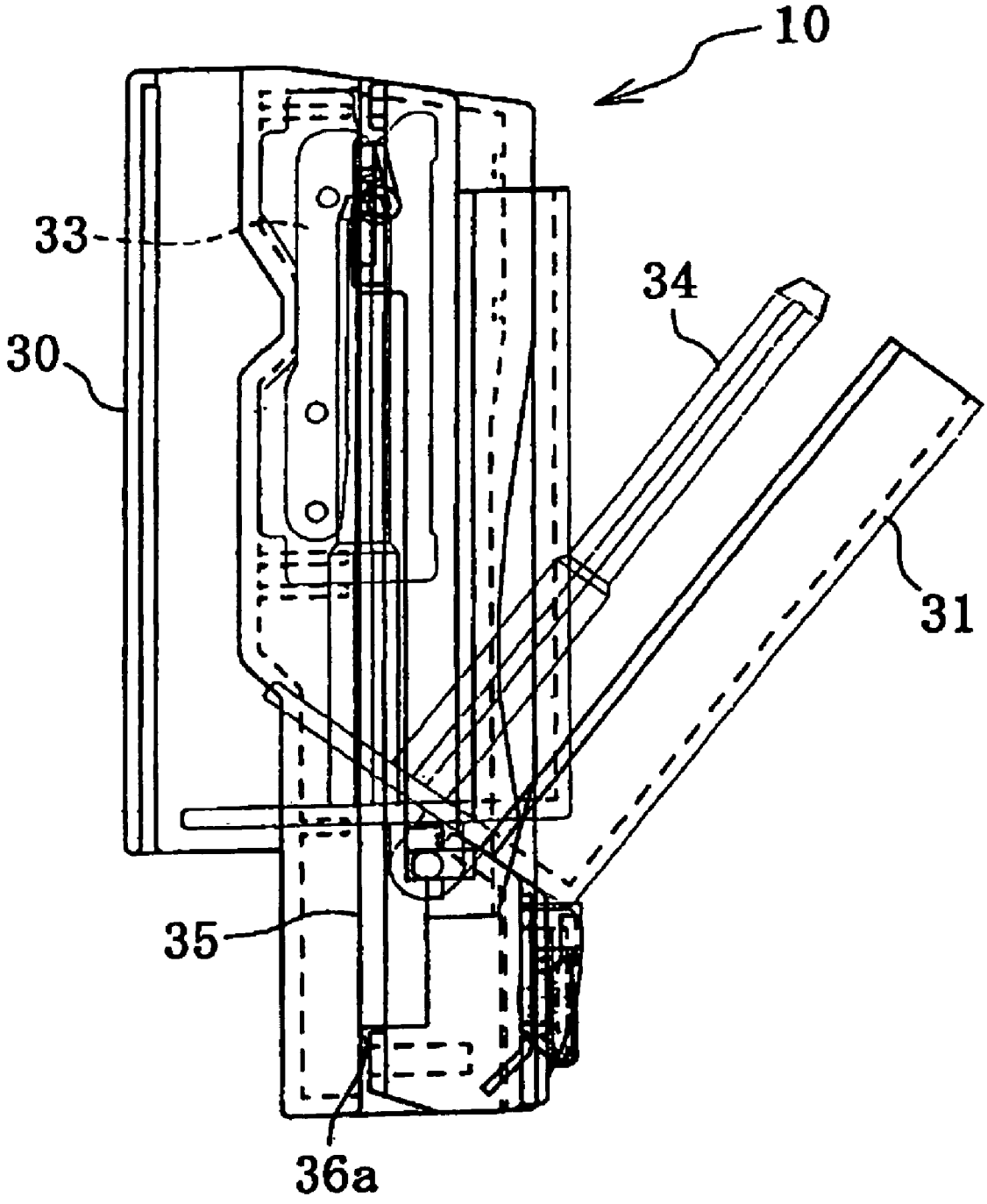
FIG. 5 is a left side view of the thread cassette.
Figure 6:
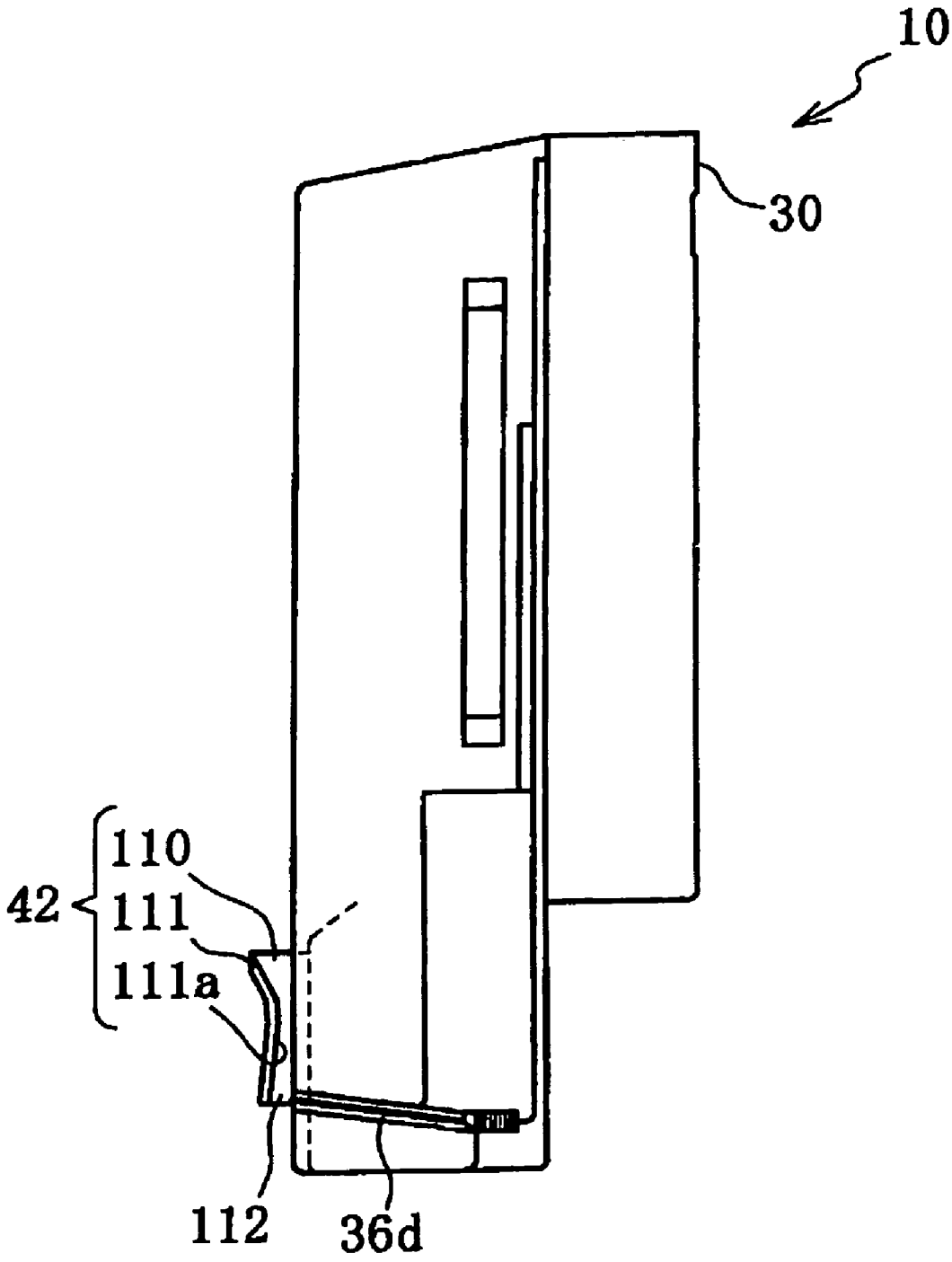
FIG. 6 is a right side view of the thread cassette.
Figure 7:
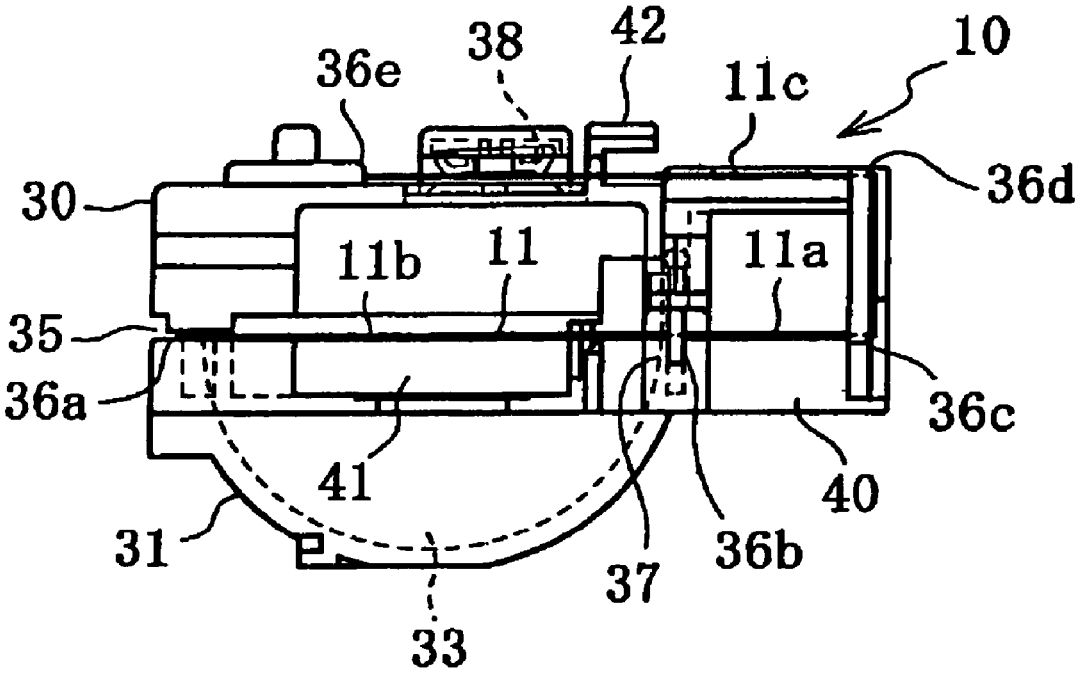
FIG. 7 is a bottom view of the thread cassette.

The thread cassette 10 will now be described in detail. The thread cassette 10 includes a cassette body 30 and a lid 31 pivotally mounted on the cassette body as shown in FIGS. 4 to 7. The cassette body 30 with the lid 31 defines therein a thread accommodating cavity 33 for accommodating a thread spool 32 serving as a supply of thread. A spool pin 34 is mounted on the lid 31. When the lid 31 is opened forward as shown in FIG. 5, the thread spool 32 is allowed to be attached to and detached from the spool pin 34. When the lid 31 is closed with the thread spool 32 attached to the spool pin 34, the thread spool is enclosed in the thread accommodating cavity 33.

The needle thread 11 is set in the following state when the thread cassette 10 has been attached to the cassette mount 5. The needle thread 11 extends upward from the thread spool 32 to be drawn out of the thread accommodating cavity 33. The thread 11 further extends through a thread path 35 defined between the cassette body 30 and a left-hand end of the lid 31. The thread 11 is then put on a first thread guard 36*a* at a left lower end of the thread cassette 10, further extending rightward thereafter to be put on a second thread guard 36*b* at a lower end of a partition wall 37 and a third thread guard 36*c* at a right lower end of the thread cassette 10. The thread 11 further extends forward to be put on a fourth thread guard 36*d* and is then returned to extend leftward. The thread 11 is then retained on a thread retainer 38. Furthermore, the thread 11 extending leftward is cut by a left blade 29 of the thread retainer 38 and the resultant thread end is put on a fifth thread guard 36*e* near the blade 39.

A needle thread take-up lever guide space 40 defined at a right end of the thread cassette 10 extends substantially over the length of the cassette. The guide space 40 is open at the rear and the lower portion of the cassette. A thread tensioning space 41 is defined at a central lower end of the thread cassette 10 and open at a lower portion thereof. These spaces 40 and 41 are partitioned by a partition wall 37. A pair of right and left escape grooves 43*a* and 43*b* are formed in the right-hand front of the thread cassette 10. The escape grooves 43*a* and 43*b* prevent a holding member 70 of the thread holding mechanism 17 from interference with the right-hand front of the thread cassette 10.

The thread cassette 10 is descended to be inserted into the cassette mount 5. In this case, the needle thread take-up lever 13 enters the guide space 40 from below the cassette, whereas the thread tensioning mechanism 14 enters the thread tension space 31 from below the cassette. When the thread cassette 10 has been inserted slightly into the cassette mount 5, a thread part 11*a* between the thread guards 36*b* and 36*c* is caught by the needle thread take-up lever 13 in the guide space 40.

Figure 22:
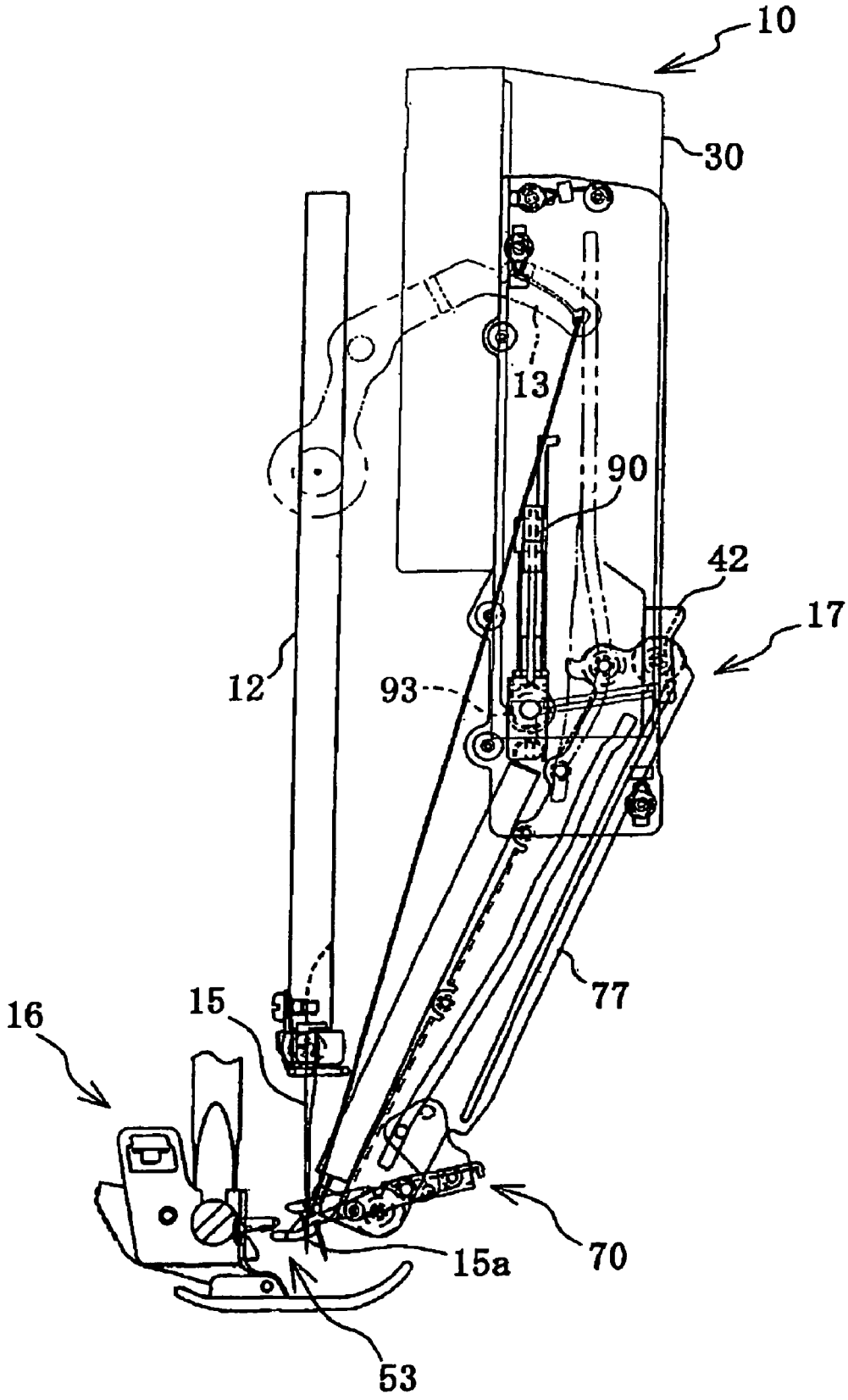
FIG. 22 is a partial side view of the sewing machine head immediately after the threading operation.

Subsequently, when the thread cassette 10 is further inserted into the cassette mount 5, a thread part 11*b* between the thread guards 36*a* and 36*b* is held by the thread tensioning mechanism 14 in the thread tension space 41. On the other hand, a thread part 11*c* between the thread guard 36*d* and the thread retainer 38 is drawn near the needle eye 15*a* by the thread holding mechanism 17 to be held as shown in FIG. 22. A cam member 42 which will be described later is provided between the thread guard 36*d* and the thread retainer 38. The cam member 42 rocks a thread nipping member 74 of the thread holding mechanism 17.

Figure 8A:
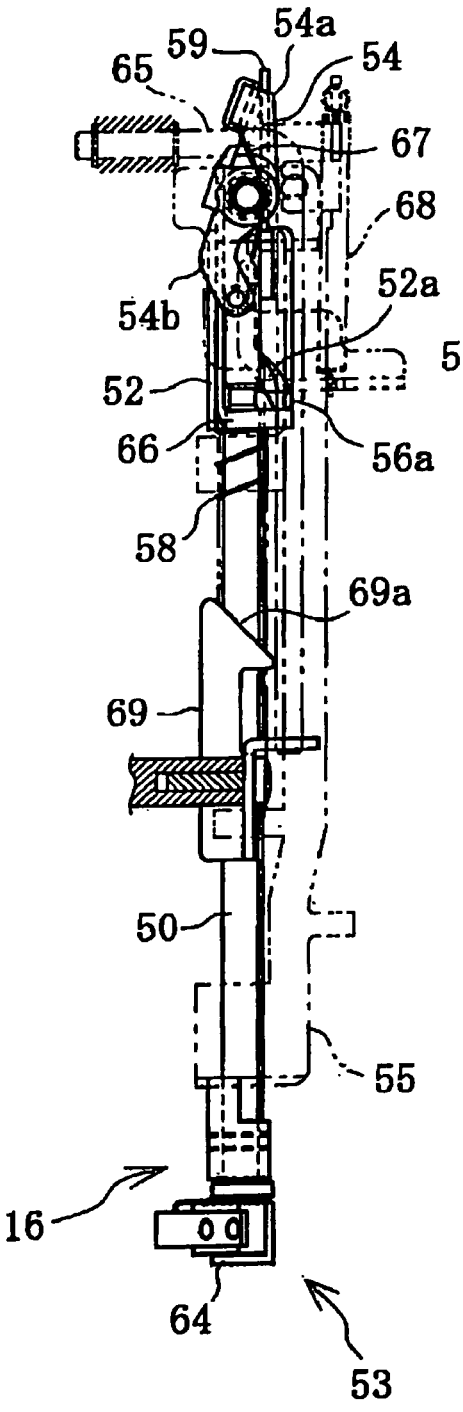
FIGS. 8A and 8B are a left side and front views of the threading mechanism respectively.
Figure 8B:
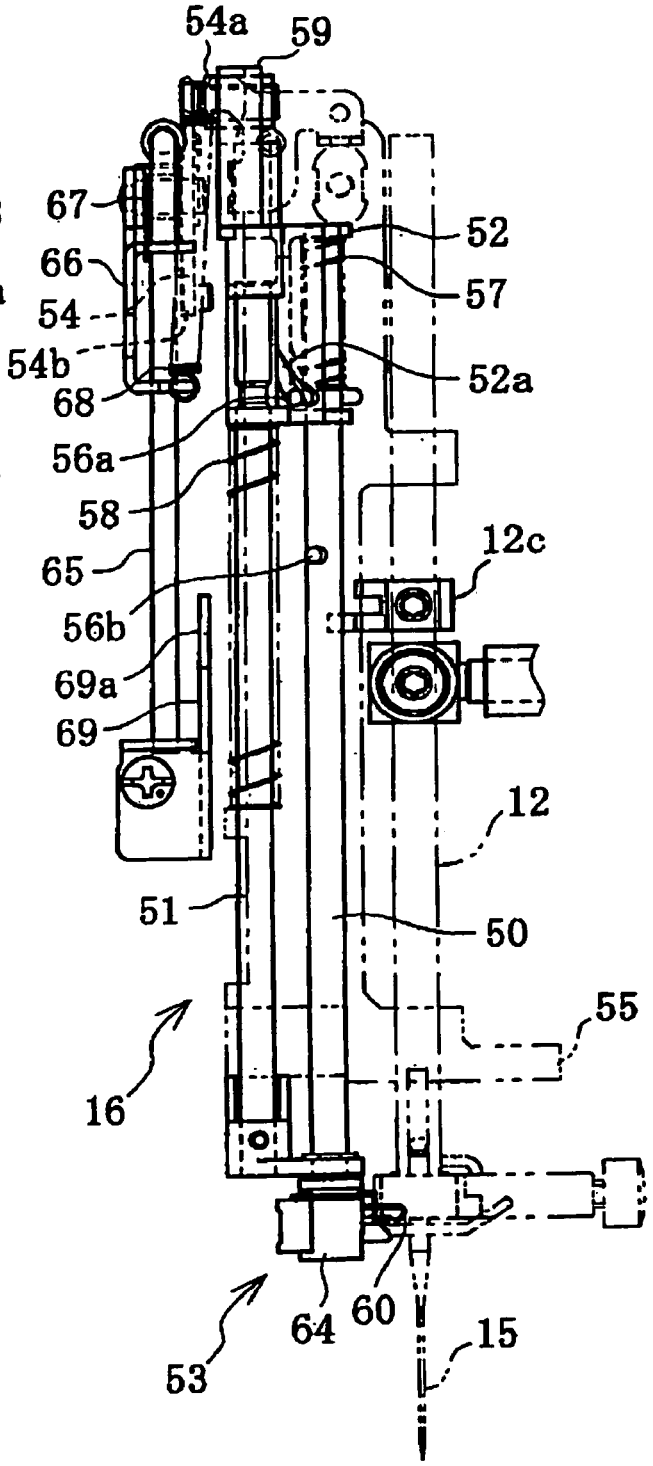

The threading mechanism 16 will be described. Referring to FIG. 8, the threading mechanism 16 includes a threading shaft 50 and a slider guide shaft 51 both provided on the left of the needle bar 12 for vertical movement, a threading slider 52 fitted with upper ends of the shafts 51 and 52 so as to be moved up and down, a hook mechanism 53 for passing the needle thread 11 through the needle eye 15*a* in synchronization with rotation of the threading shaft 50 coupled with the upper ends of the shafts 50 and 51, and a threading shaft driving member 54 for driving the threading shaft 50 in synchronization with the attaching operation of the thread cassette 10.

The threading shaft 50 and the slider guide shaft 51 are supported on the needle bar mount 55 together with the needle bar 12. The needle bar 12, threading shaft 50 and slider guide shaft 51 are rocked together by a needle bar rocking mechanism. The needle bar 12 (or needle 15) needs to be located at a predetermined position where the needle thread 11 held by the thread holding mechanism 17 can be passed through the needle eye 15*a* by the hook mechanism 53. For this purpose, the needle bar 12 is located at a leftmost position immediately before the threading operation by the threading mechanism 16 (immediately before attachment of the thread cassette 10). Furthermore, regarding the vertical position, the needle bar 12 is located at a position where the needle thread 11 can be passed through the needle eye 15*a* or more specifically, a predetermined position slightly lower than the uppermost position.

Two upper and lower pins 56*a* and 56*b* protrude from an upper portion of the threading shaft 50 and a vertically middle portion of the shaft. When the threading shaft 50 is lowered a predetermined amount, the pin 56*b* engages a limiting member 12*c* fixed to the vertically middle portion of the threading shaft 2. Furthermore, a coil spring 57 is provided around the threading shaft 50 for urging the threading slider 52 upward. Another coil spring 58 is provided around an upper half of the slider guide shaft 51 for urging the threading slider 52 upward. The threading slider 52 is formed with a cam groove 52*a* including an upper half straight groove and a lower half spiral groove. Furthermore, the threading slider 52 is provided with an upwardly protruding plate 59. The backside of the protruding plate 59 is formed into a horizontal plane (not shown).

Referring to FIGS. 8 and 9, the hook mechanism 53 includes a threading hook 60 for catching the needle thread 11, two guide members 61 and 62 disposed at both sides of the threading hook 60, a thread holding wire horizontally extending through the threading hook 60 and the guide members 61 and 62, and a hook holding member 64 fixed to the lower end of the threading shaft 50 and holding the threading hook 60 and guide members 61 and 62. The threading hook 60 has a distal end formed with a hook portion 60*a* as shown in FIG. 9. In the threading, the hook portion 60*a* is passed through the needle eye 15*a* and the threading hook 60 is guided by the two guide members 61 and 62. Under these conditions, the needle thread 11 held near the needle eye 15*a* by the thread holding mechanism 17 is caught by the threading hook 60.

A threading shaft driving member 54 is rotatably coupled to a slide member 66 fitted with a guide shaft 65 so as to be vertically slidable. The threading shaft driving member 54 is urged by a torsion coil spring 67 in the clockwise direction as shown in FIG. 8A. On the other hand, the slide member 66 is urged upward by a coil spring 68. The threading shaft driving member 54 has an upper end formed with a driving force transmitting portion 54*a* abutting the horizontal plane of the plate 59 to transmit a driving force to the threading slider 52 for the attachment of the thread cassette 10. The threading shaft driving member 54 has a lower end formed with a cam portion 54*b* for preventing the driving force from transmitting to the threading slider 54. The guide shaft 65 has a lower end to which a cam member 69 is fixed. The cam member 69 has an inclined distal cam portion 69*a*. The cam portion 54*b* abuts against the distal cam portion 69*a* when the threading shaft driving member 54 is moved downward a predetermined amount.

The threading operation by the threading mechanism 16 will now be described. When the threading shaft driving member 54 is driven downward against the urging force of the coil spring 68 in synchronization with attachment of the thread cassette 10, the driving force transmitting portion 54*a* abuts the horizontal plane of the plate 59 so that the driving force is transmitted to the plate 59, whereupon the threading shaft 51 and the slider 15, guide 52 are moved downward, too. When the threading shaft 50 is moved downward a predetermined amount, the pin member 56*b* engages the limiting member 12*c* thereby to prevent further downward movement of the threading shaft 50. However, the threading slider 52 is further moved downward against the urging force of the coil spring 58. Since the pin member 56*a* of the threading shaft 50 is moved along the cam groove 52*a* of the threading slider 52 relative to the threading shaft 50, the downward movement of the threading slider 52 relative to the threading shaft 50 is converted to rotational movement of the threading shaft 50, whereby the shaft 50 pivots a predetermined angle. In this case, as shown in FIG. 9A, the hook mechanism 53 provided at the lower end of the threading shaft 50 is also rotated with the threading shaft, whereupon the hook portion 60*a* of the threading hook 60 is passed through the needle eye 15*a* and catches the needle thread 11.

Figure 9A:
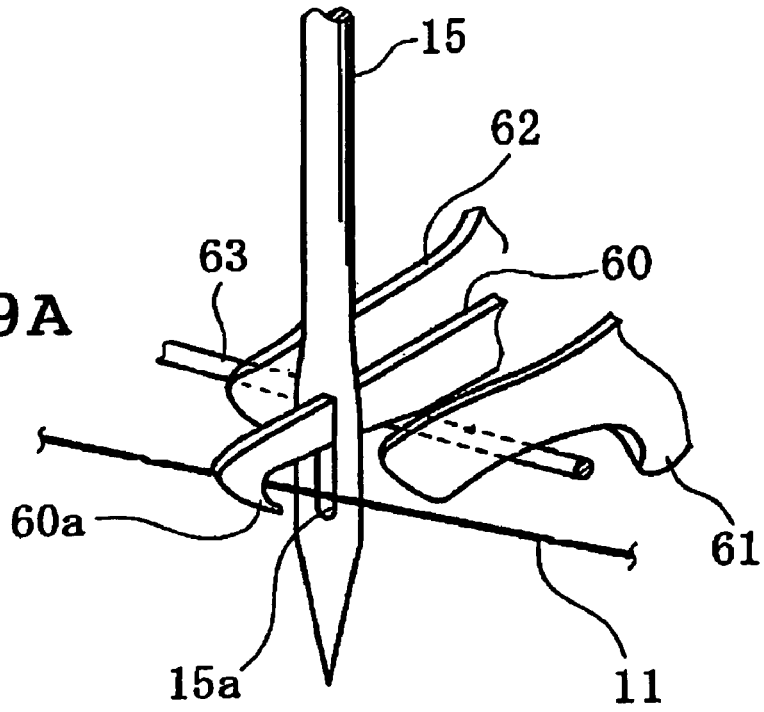
FIGS. 9A and 9B are perspective views of the hook mechanism immediately before threading and upon completion of threading respectively.
Figure 9B:
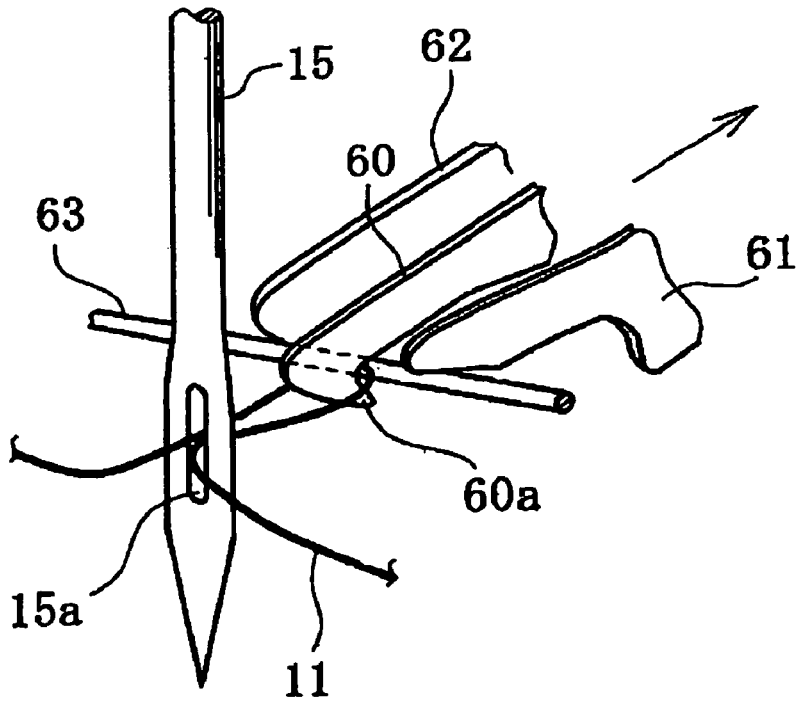

While the needle thread 11 is caught on the hook 60*a*, the threading shaft driving member 54 is moved downward to a predetermined position and the cam portion 54*b* abuts the distal cam portion 69*a* of the cam member 69, as shown in FIG. 9A. Furthermore, when the thread cassette 10 is further pushed into the cassette mount 5 such that the threading shaft driving member 54 is moved downward, the threading shaft driving member 54 is rotated counterclockwise against the urging force of the torsion coil spring 67 as shown in FIG. 8A. Consequently, since the driving force transmitting portion 54*a* departs from the horizontal plane of the protruding plate 59, the driving force for driving the threading shaft 50 downward is not transmitted. Accordingly, the threading shaft 50 is rotated in the opposite direction and returned upward by the urging force of the coil spring 58. With this, since the hook mechanism 53 is rotated in such a direction as to depart from the needle 15, the threading hook 60 catching the needle thread 11 is pulled through the needle eye 15*a* as shown in FIG. 9B, thereby completing the threading operation.

The thread holding mechanism 17 will now be described. The thread holding mechanism 17 includes a holding member 70 having a pair of spaced-apart thread holding portions 71 and 72 capable of holding the needle thread 11, a synchronous moving mechanism 73 for moving the thread holding portions 71 and 72 near the needle eye 15*a* in synchronization with attachment of the thread cassette 10, a thread holding portion 74 releasably holding the needle thread 11 between the left thread holding portion 71 and itself, a torsion coil spring 75 (urging member) elastically urging the thread holding portion 74 toward the holding portion 71, and a cam member 42 mounted on the cassette body 30 of the thread cassette 10 and rocking the thread holding portion 74 to a side where the needle thread 11 is temporarily released in synchronization with a predetermined stage of the step of attaching the thread cassette.

The thread holding mechanism 17 further includes a base frame 76 fixed to the head 4 and a moving frame 77 supported so as to be moved upward and downward. The holding member 70 is fixed to the moving frame 77 which is moved by a sequential moving mechanism 73. The base frame 76 has guide members 78 located at both sides of the vertical movement path of the needle thread take-up lever 13 and a pair of guide plates 79*a* and 79*b* (see FIG. 3) provided on the left of the guide members for guiding the moving frame 77. The moving frame 77 comprises a pair of moving plates 80*a* and 80*b* provided between the guide plates 79*a* and 79*b*. The moving plates 80*a* and 80*b* are connected to each other by a plurality of connecting pins.

Figures 11A, 11B, 11C:
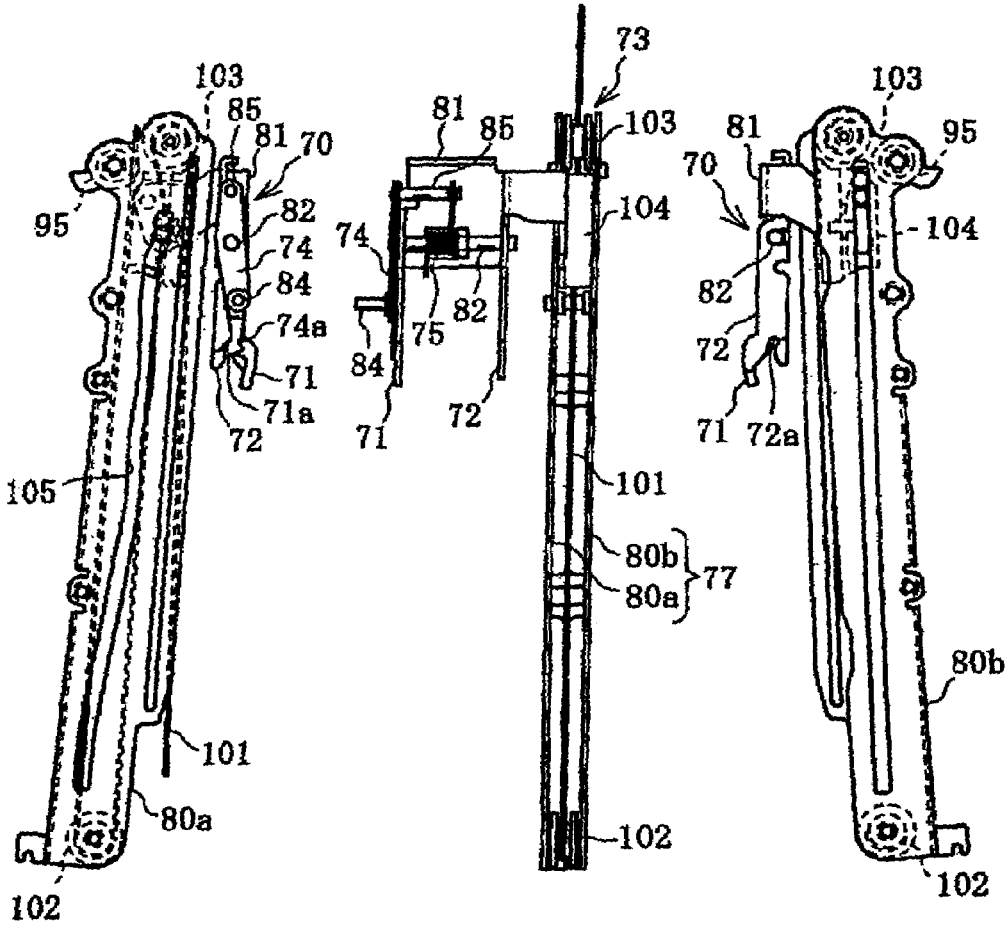
FIGS. 11A, 11B and 11C are left side, front and right side views of the holding member and moving frame, respectively.

The holding member 70 and the thread nipping member 74 will be described with reference to FIGS. 11A to 11C. The thread holding portions 71 and 72 of the holding member 70 are connected to each other by a connecting member 81. The connecting member 81 has a right end extending horizontally rightward and is fixed to a holding member support 104 further fixed to a second wire 101 of the interlock transfer mechanism 73. The thread holding portions 71 and 72 are formed with recesses 71*a* and 72*a* for catching the needle thread 11 in the attachment of the thread cassette 10 respectively. The thread nipping member 74 is mounted on a pivot shaft 82 further pivotally mounted on the left-hand thread holding portion 71. A torsion coil spring is provided around the pivot shaft 82.

The thread nipping member 74 has a lower end including a front portion formed with a recess 74*a* holding the needle thread 11 in cooperation with the left thread holding portion 71 therebetween. A driven pin 84 is provided on the lower end so as to be operated by a cam member 42 as will be described later. On the other hand, the thread nipping member 74 has an upper end (which is opposed to the driven pin 84 relative to the pivot shaft 82) on which a limit pin 85 is provided. The limit pin 85 limits a rocking motion of the thread nipping member 74 to a thread holding side over a predetermined range. The driven pin 84 protrudes leftward and the limit pin 85 protrudes rightward.

Figure 12:
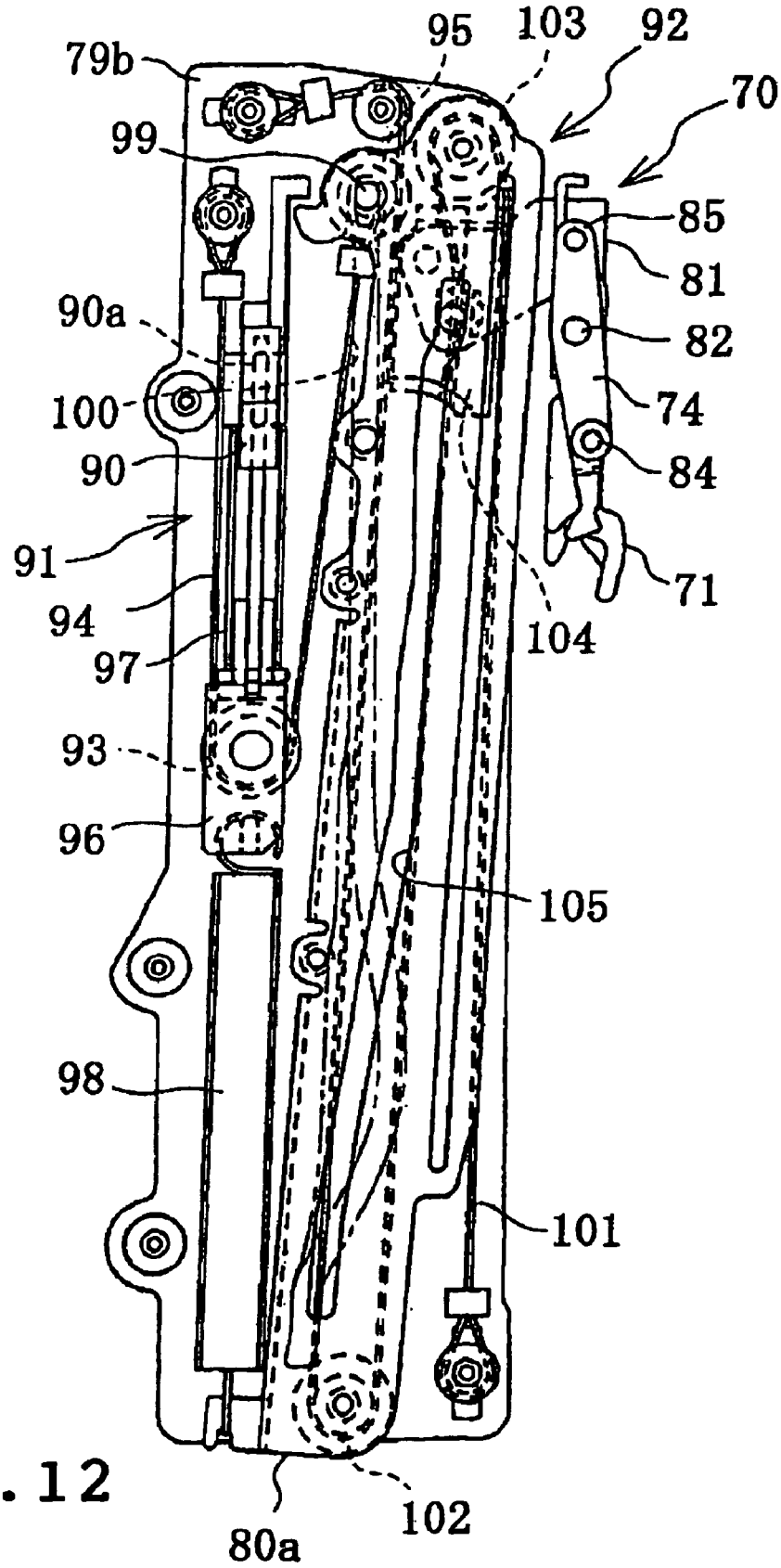
FIG. 12 is a side view of the holding member and synchronous moving mechanism.

The interlock transfer mechanism 73 will be described. Referring to FIGS. 11A to 12, the interlock transfer mechanism 73 comprises a cassette contact 90 made of a synthetic resin and coming into contact with the thread cassette 10 to be lowered with the cassette during attachment of the thread cassette. The interlock transfer mechanism 73 further includes first and second running blocks 91 and 92 moving the holding member 70 by an amount four times larger than an amount of movement of the cassette contact 90. The cassette contact 90 is vertically movable between right and left guide plates 79*a* and 79*b* of the base frame 76. The cassette contact 90 has a contact portion 90*a* formed on the left end side thereof so as to protrude leftward from the left-hand guide plate 79*a*. The lower end of the thread cassette 10 is brought into contact with the contact portion 90*a*.

The first running block 91 comprises a pulley 93 coupled with the cassette contact 90 so as to be vertically moved together, a first wire 94 wound on the pulley 93 and having one end fixed to the guide plate 79*b*, and a pulley 95 connected to the other end of the first wire 94. The pulley 93 is enclosed in a pulley enclosing member 96 made of a synthetic resin. The pulley enclosing member 96 is vertically movable together with the pulley 93 between the paired guide plates 79*a* and 79*b* below the cassette contact 90. A coil spring 97 is provided between the cassette contact 90 and the pulley enclosing member 96 for urging the cassette contact 90 upward relative to the pulley 93. On the other hand, the pulley 93 (and the pulley enclosing member 96) is urged upward by a coil spring 98 which returns the moving frame 77 upward. The coil spring 98 has a lower end connected to a lower end of the left moving plate 80*a*.

The first wire 94 has one end fixed to a portion of the guide plate 79 located above the cassette contact 90 and the other end fixed to a pin member 99 connecting the upper ends of the moving plates 80*a* and 80*b*. The pin member 99 is supported by the guide plates 79*a* and 79*b* so as to be moved vertically along a guide groove 100. The pulley 95 is rotatably supported on the pin member 99. Accordingly, the pulley 95 and the moving plates 80*a* and 80*b* (or moving frame 77) are vertically movable relative to the guide plates 79*a* and 79*b* (or fixed frame 76) under the condition where the pin member 99 is guided by the guide groove 100.

When the cassette contact 90 comes into contact with the thread cassette 10 to be pushed downward during attachment of the thread cassette, the pulley 93 is also pushed downward together with the thread cassette 10. Since the pulley 93 serves as a running block in this case, the pulley 95 and accordingly the moving frame 77 are moved downward by an amount twice as large as an amount of movement of the cassette contact 90.

The second running block 92 comprises a second wire 101 having both ends fixed to the guide plate 79*b* and two pulleys 102 and 103 on both of which the second wire is wound. The pulleys 102 and 103 are rotatably supported on the lower and upper ends of the moving plates 80*a* and 80*b* respectively. The one end of the second wire 101 is fixed to the upper end of the guide plate 79*b*, whereas the other end of the second wire 101 is fixed to the lower end of the guide plate 79*b* while the second wire is wound on the pulleys 102 and 103.

Figure 13A:
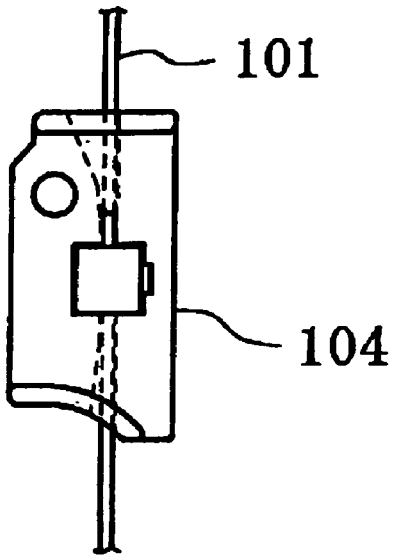
FIGS. 13A and 13B are left and right side views of the holding member support respectively.
Figure 13B:
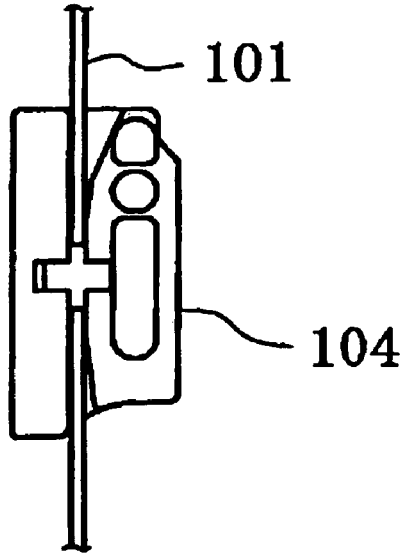
Figure 14:
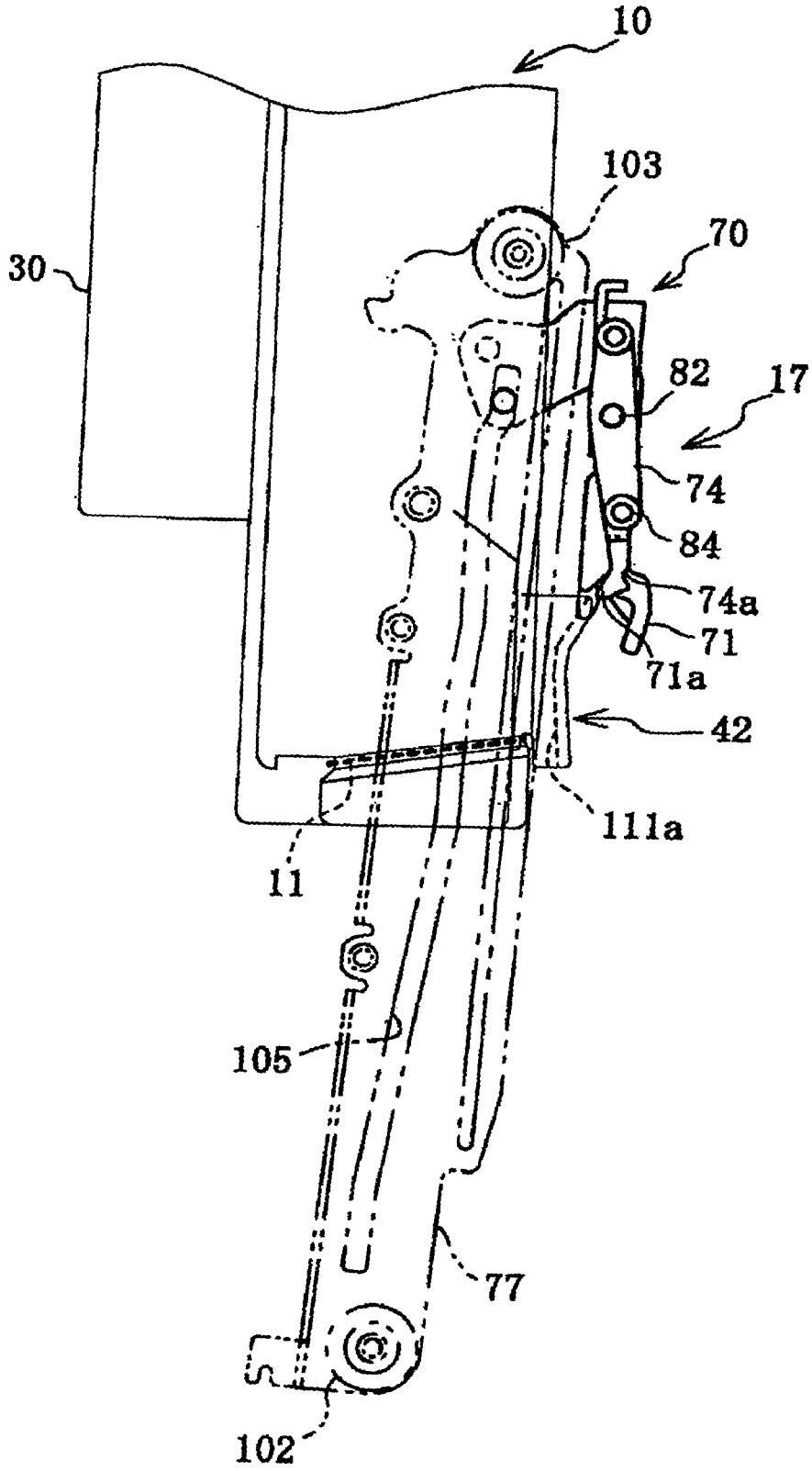
FIG. 14 illustrates a working condition of the holding member and thread nipping member (immediately before movement of the holding member)

Referring to FIGS. 12 to 13B, a holding member support 104 made of a synthetic resin is fixed to a portion of the second wire 101 located between the pulleys 102 and 103. The connecting member 81 of the holding member 70 is connected to the holding member support 104. The connecting member 81 and the holding member support 104 are supported so as to be movable vertically along the guide groove 105 between the paired moving plates 80*a* and 80*b*.

When the moving plates 80*a* and 80*b* are moved downward by the first running block 91, the pulleys 102 and 103 are also moved downward with movement of the moving plates 80*a* and 80*b*. The pulley 102 thus serves as a running block in this case. When a portion of the wire 101 wound on the pulley 102 is thrust downward, the second wire 101 is moved from the front side of the pulley 102 (right side as viewed in FIG. 12) to the rear side (left side as viewed in FIG. 12) by an amount twice as large as an amount of movement of the pulley 102. In other words, the holding member 70 connected to the portion of the second wire 101 between the pulleys 102 and 103 is also moved downward by an amount twice as large as an amount of movement of the pulley 102. Accordingly, an amount of movement of the holding member 70 becomes four times larger than an amount of movement of the thread cassette 10.

The cam member 42 will now be described. Referring to FIGS. 4, 6, 7 and 10, the cam member 42 is formed integrally in the right rear end of the cassette body 30 so as to protrude from the front of the cassette body. The cam member 42 includes a protruding portion 110 protruding forward from the front of the cassette body 30 and a cam portion 111 extending rightward from the front end of the protrusion 110. A pin passage 112 is defined between the cam portion 111 and the front of the thread cassette 10. The drive pin 84 is passed through the pin passage 112 relative to the thread cassette 10 during attachment of the cassette.

The cam portion 111 has a cam face 111*a* formed in the rear thereof. The driven pin 84 is moved or slid along the cam face 11*a* during attachment of the thread cassette 10. The cam face 111*a* has an upper inclined face inclined downwardly rearward and a lower inclined face continuous to the lower end of the upper inclined face and inclined downwardly forward. Thus, the cam face 111*a* facing the front of the thread cassette 10 is formed so as to protrude rearward. A boundary portion of the upper and lower inclined faces is bent, and the cam face 111*a* protrudes rearmost at the bent portion. Accordingly, the driven pin 84 is passed through the pin passage 112 along the cam face 111*a* as the thread cassette 10 is moved downward. Thus, the driven pin 84 is operated by the cam member 42 so that the thread nipping member 74 is rocked back and forth. At this time, the needle thread 11 is held between the thread holding portion 71 and the thread nipping member 74.

Figure 15:
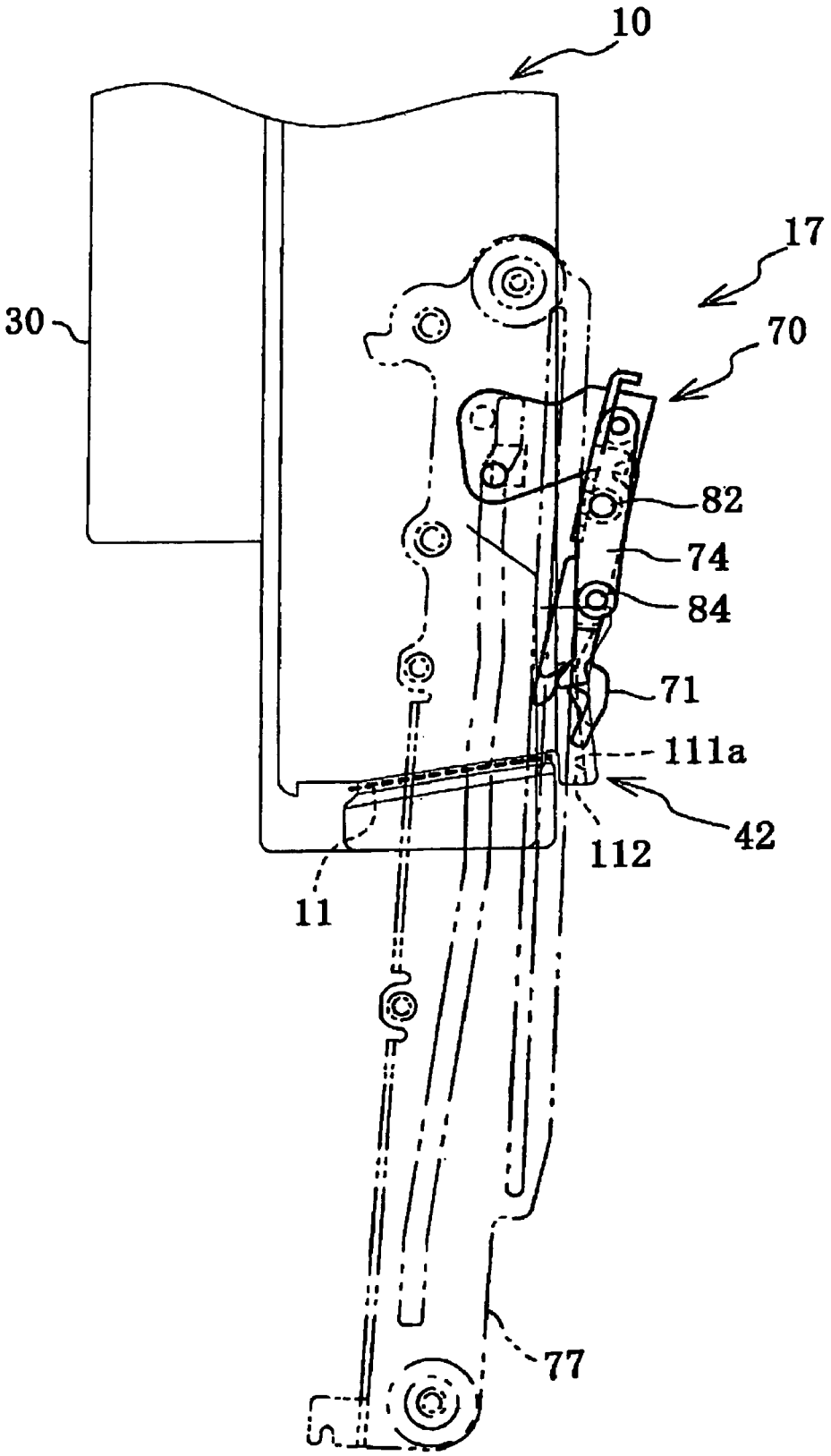
FIG. 15 also illustrates another working condition of the holding member and thread nipping member (immediately after start of movement of the holding member)

Referring to FIGS. 10 and 14 to 23, the thread holding operation of the thread holding mechanism 17 will be described with main attention to the holding of the needle thread 11 by the thread holding portion 71 and the thread nipping member 74. The thread nipping member 74 is urged to the thread holding side by the torsion coil spring 75 immediately after the thread cassette 10 comes into contact with the cassette contact 90. When the thread cassette 10 is then thrust into the cassette mount 5, the holding member 70 is moved downward in synchronization with attachment of the threads cassette 10, as shown in FIG. 15. The holding member 70 is moved downward relative to the thread cassette 10 since a movement amount of the holding member 70 is rendered four times larger than a movement amount of the thread cassette 10 by the first and second running blocks 91 and 92.

Figure 16:
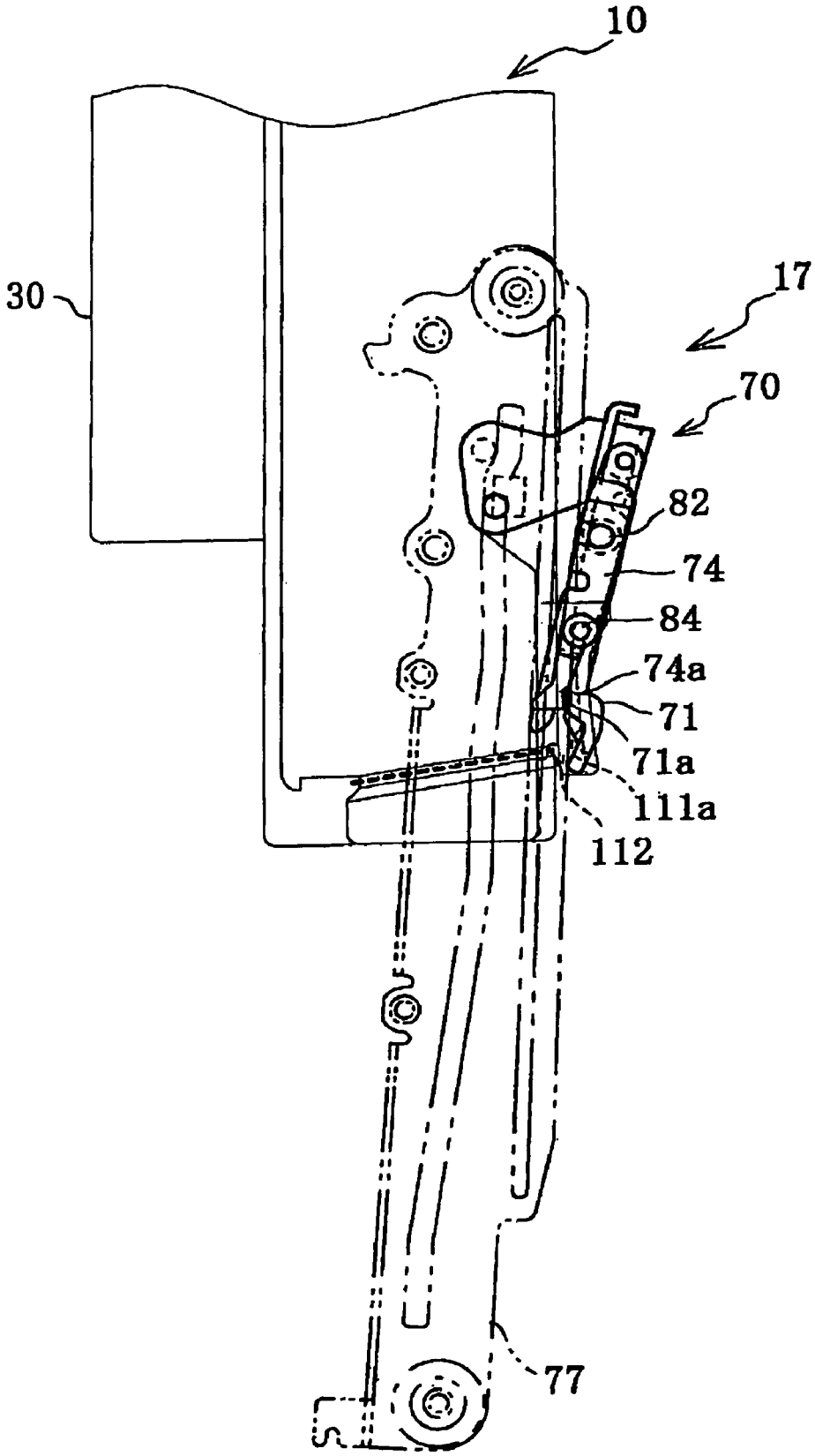
FIG. 16 illustrates further another working condition of the holding member and thread nipping member (at the start time of the rocking motion of the thread nipping member)
Figure 17:
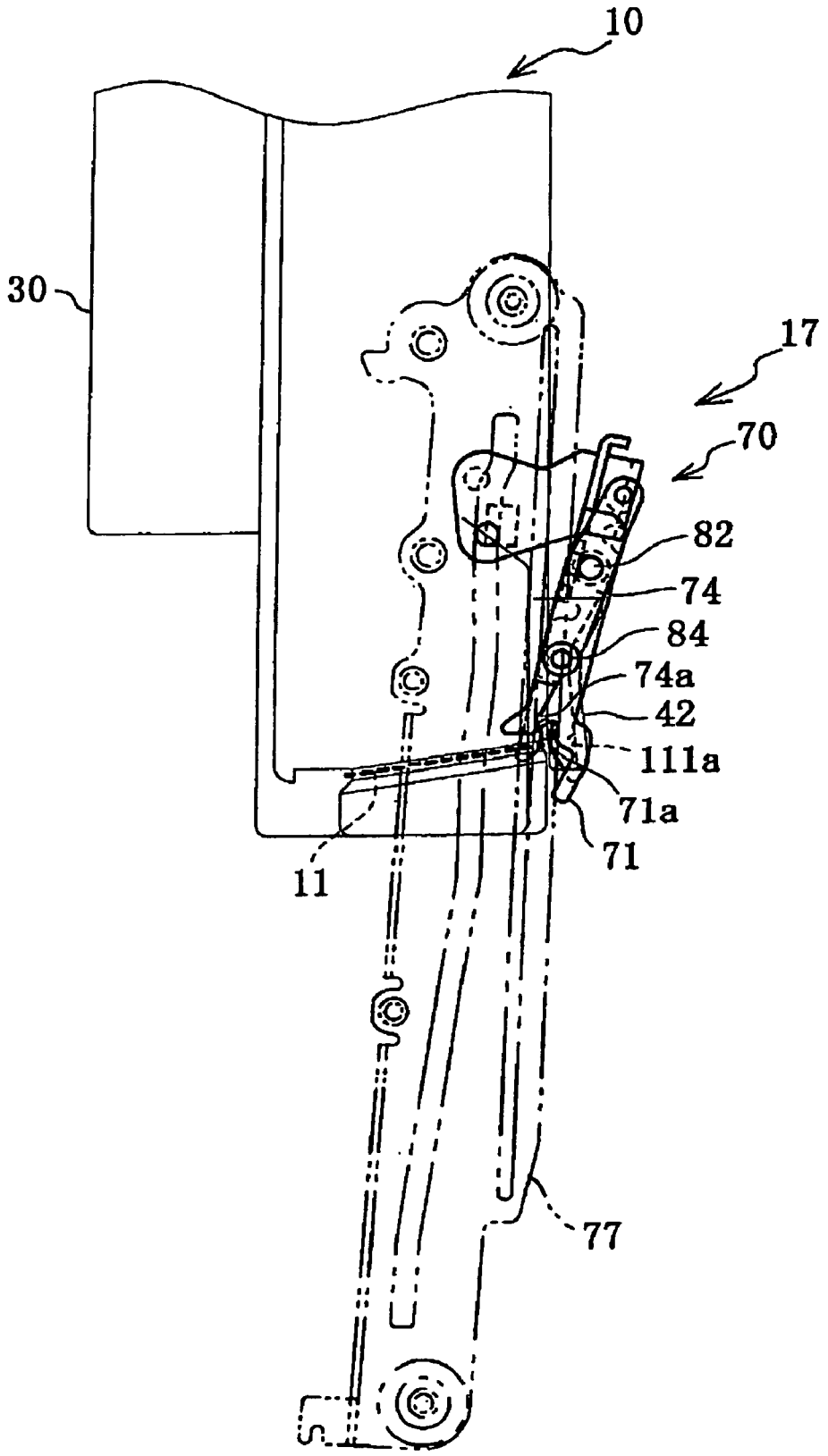
FIG. 17 illustrates further another working condition of the holding member and thread nipping member (in the maximum rocking motion of the holding member)

The driven pin 84 is thrust rearward by the cam face 111*a* when reaching the pin passage 112 formed inside the cam member 42, as shown in FIG. 16. With this, the thread nipping member 74 starts to be rocked about the pivot shaft 82 to the hold releasing side. Upon further downward movement of the holding member 70, the thread nipping member 74 is rocked to the hold releasing side to the maximum extent when the driven pin 84 reaches a rearmost protruding portion of the cam face 111*a*, as shown in FIG. 17. At this time, the portion 11*c* (see FIGS. 4 and 7) of the needle thread 11 extending in front of the thread cassette 10 enters a space between the recesses 71*a* and 74*a* of the thread holding portion 71 and the thread nipping member 74.

Figure 18:
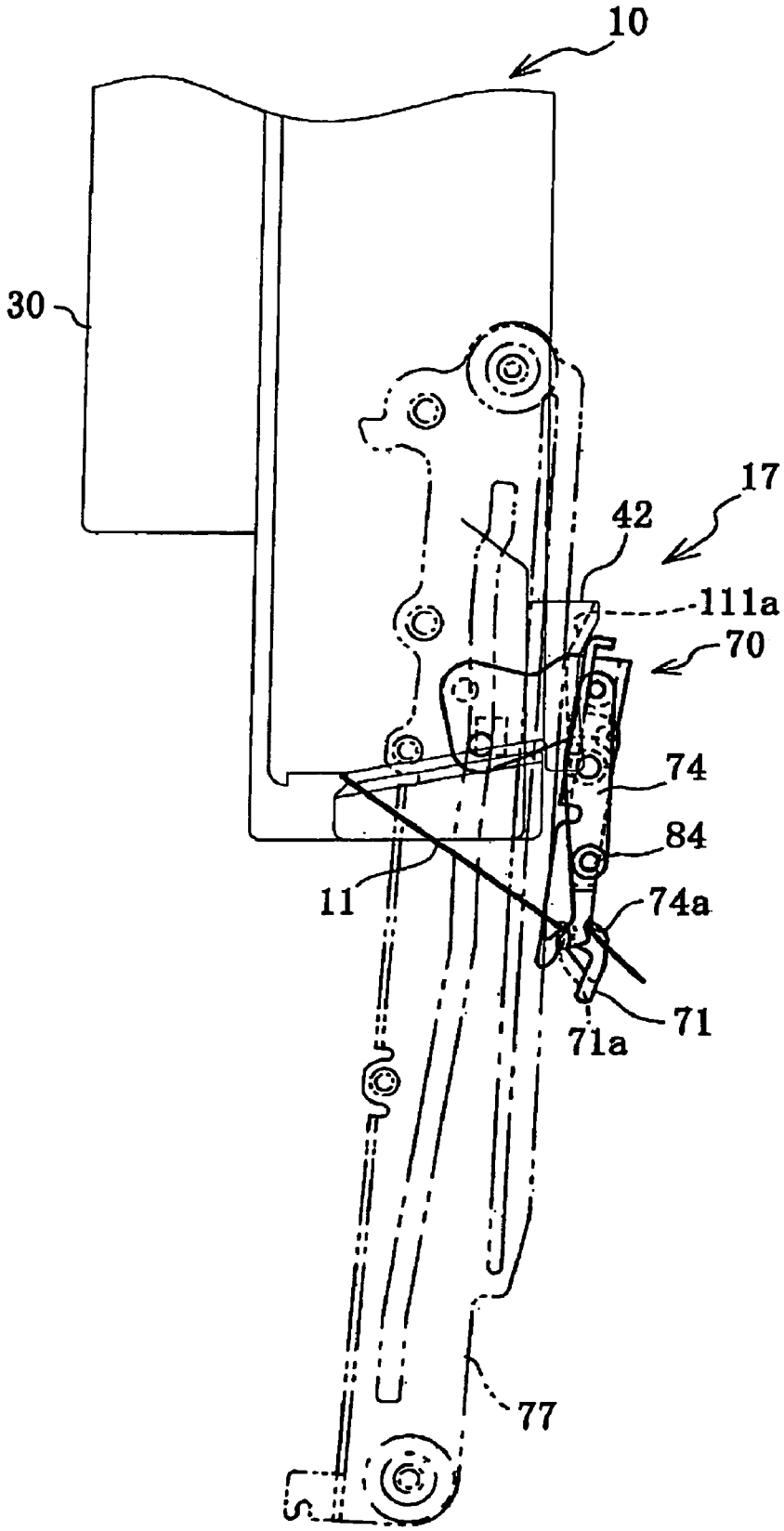
FIG. 18 illustrates further another working condition of the holding member and thread nipping member (at the completion time of the rocking motion of the holding member)

When the driven pin 84 is further moved downward along the cam face 111*a* and passes a farthest protruding portion of the cam face 111*a* within the pin passage 112, the thread nipping member 74 is urged by the torsion coil spring 75 (see FIG. 11B) to be rocked to the thread holding side. When the driven pin 84 passes through the pin passage 112 thereby to loose contact with the cam face 111*a*, the needle thread 11 is held between the recesses 71*a* and 74*a* of the thread holding portion 71 and the thread nipping member 74, as shown in FIG. 18. The limit pin 85 is upwardly spaced away from the recesses 71*a* and 74*a*.

Figure 19:
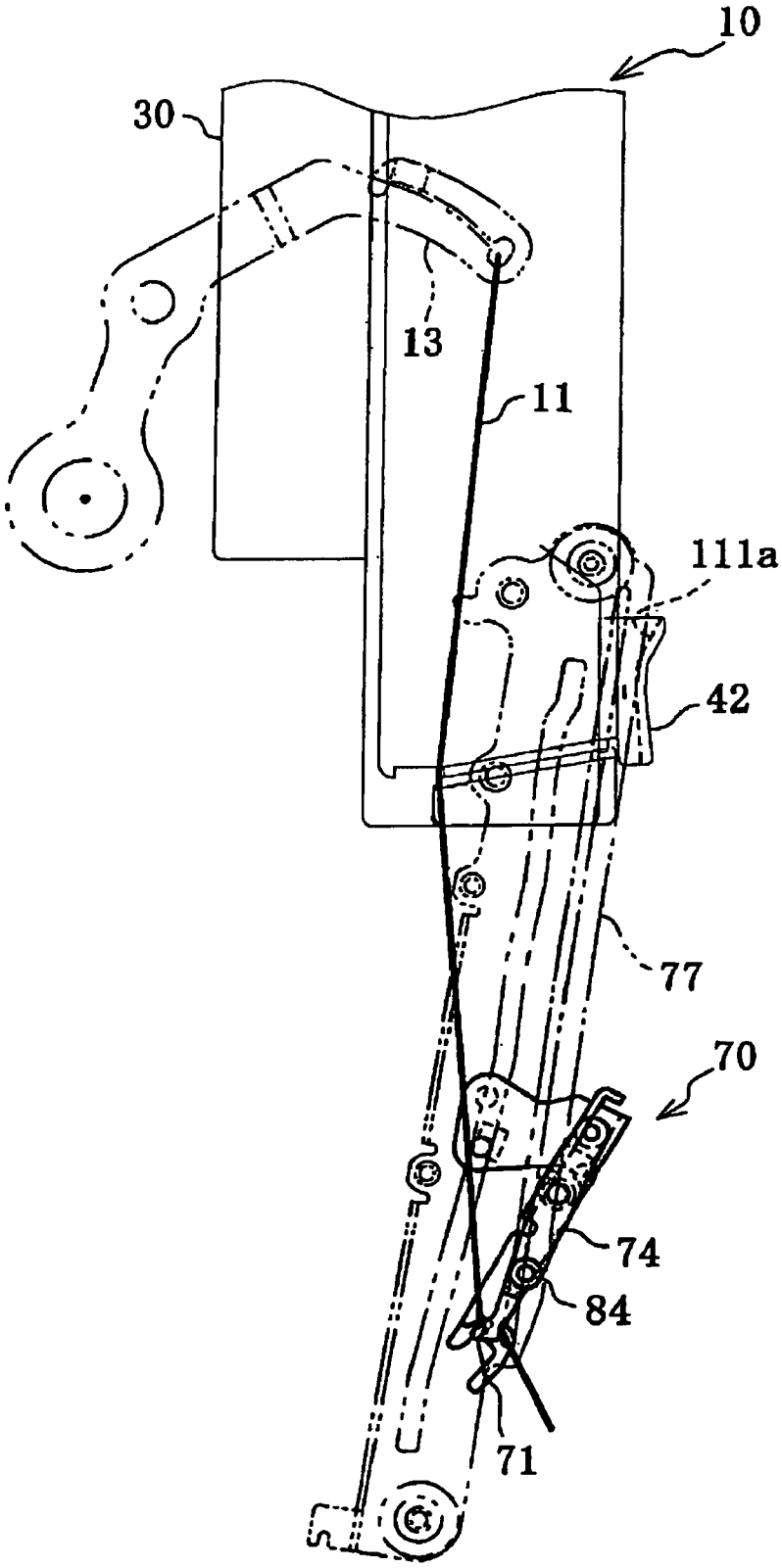
FIG. 19 illustrates further another working condition of the holding member and thread nipping member (while holding the needle thread)
Figure 20:
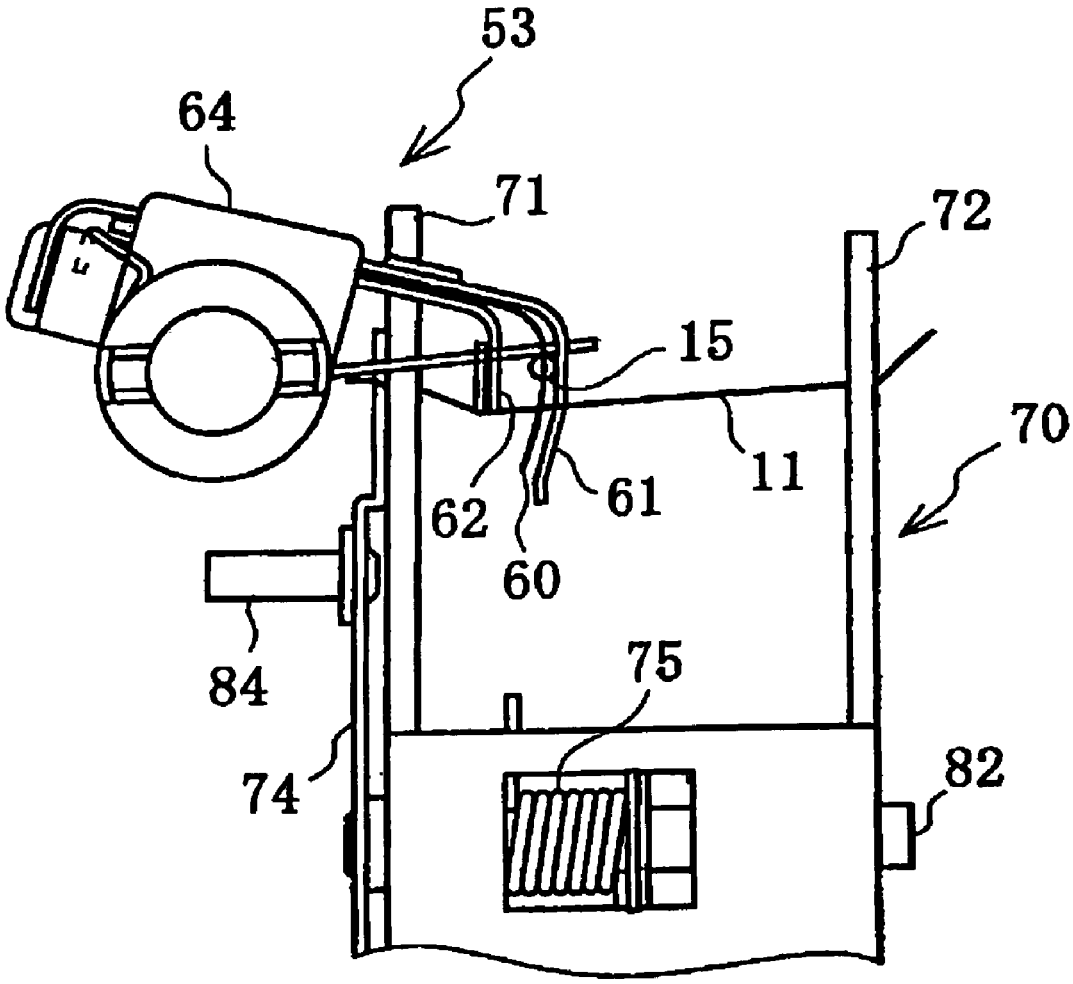
FIG. 20 is a partial plan view of the hook mechanism and holding member in the threading operation.

Thus, the moving frame 77 is further moved downward as shown in FIG. 19 while the needle thread 11 is held as described above. The needle thread 11 is held near the needle eye 15*a* by the thread holding portions 71 and 72. At this time, the hook mechanism 53 of the threading mechanism 16 is rotated clockwise such that the threading hook 60 passes through the needle eye 15*a* as shown in FIG. 20.

Figure 21:
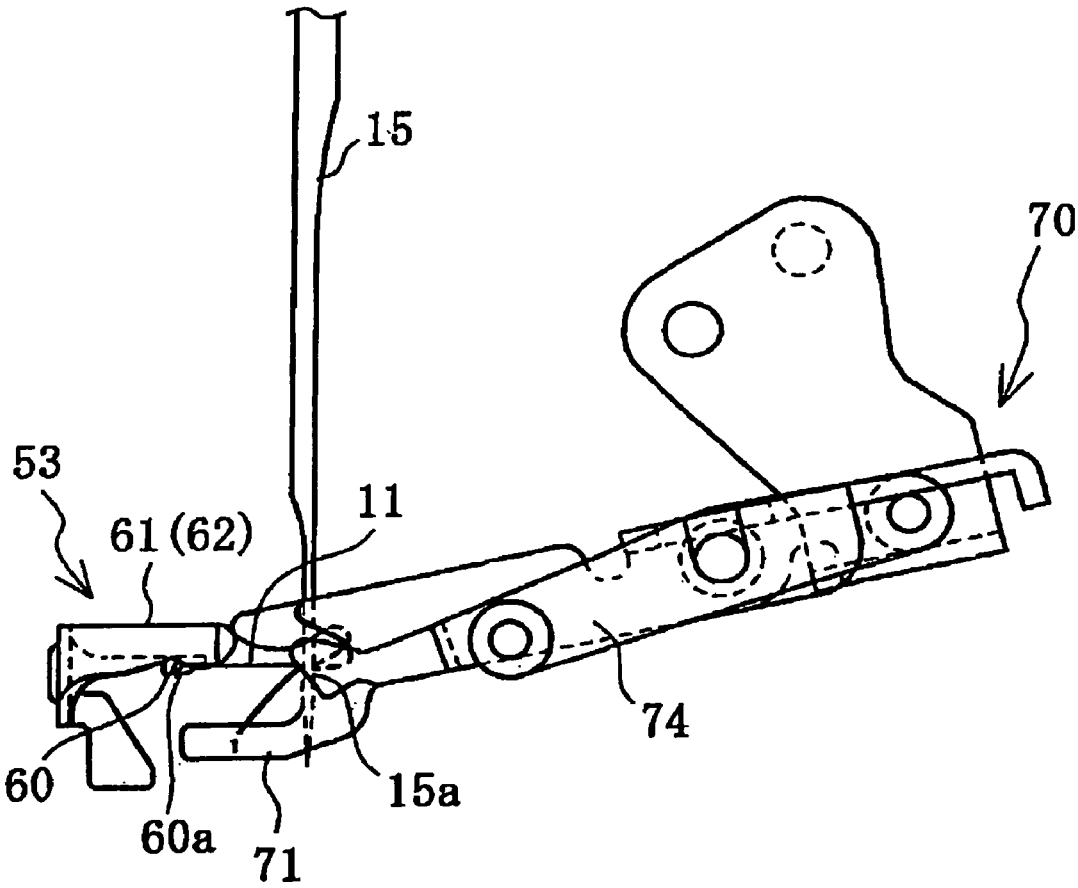
FIG. 21 is a side view of the hook mechanism and holding member in the threading operation as shown in FIG. 20.

When the holding member 70 is moved near the needle eye 15*a*, the cassette contact 90 thrust downward in contact with the lower end of the thread cassette 10 departs from the thread cassette, and the pulley 93 is moved upward by the urging force of the return coil spring 98. With this return movement, the moving frame 77 and the holding member 70 are moved upward. The needle thread 11 held by the thread holding portions 71 and 72 is caught on the threading hook 60. The hook mechanism 53 is returned counterclockwise in FIG. 20 while the needle thread 11 is caught on the threading hook 60. As a result, the needle thread 11 is passed through the needle eye 15*a* as shown in FIGS. 21 and 22.

Figure 23:
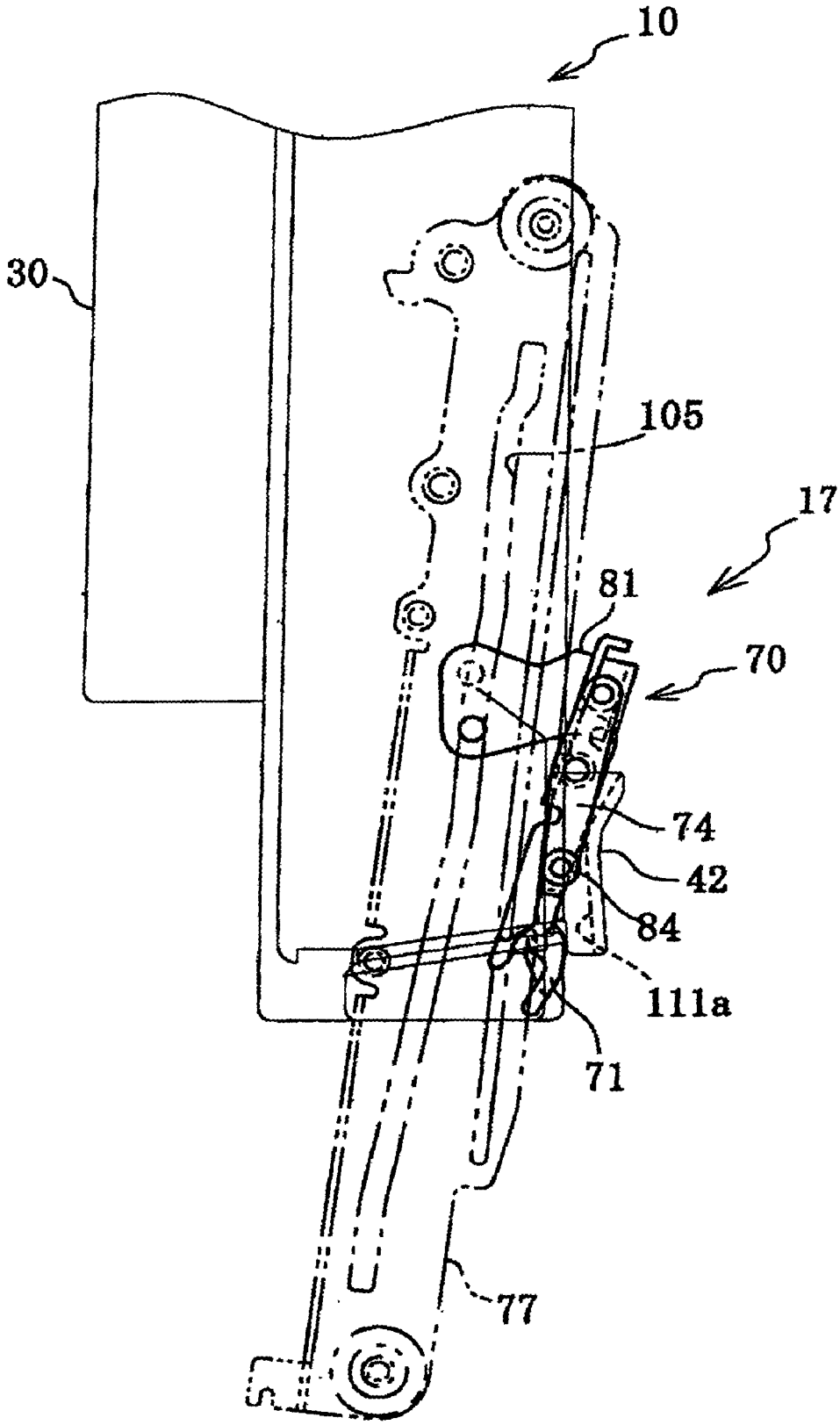
FIG. 23 illustrates a working condition of the holding member and thread nipping member (after the threading operation)

The holding member 70 is moved upward with the moving frame 70 when the needle thread 11 has been passed through the needle eye 15*a*. In this case, as shown in FIG. 23, the position where the connecting member 81 engages the guide groove 105 differs from that in the case where the holding member 70 is moved downward (see FIG. 18). Accordingly, since the driven pin 84 is spaced away from the cam face 111*a* of the cam member 42, these are prevented from interference. Consequently, the holding member 70 is smoothly moved upward. The limit pin 85 is located on the right of the thread nipping member 74 and spaced away from the cam member 42 rightward. Accordingly, the limit pin 85 does not prevent the vertical movement of the holding member 70.

The thread guide threading mechanism 18 will be described with reference to FIGS. 3 and 24 to 31. The thread guide threading mechanism 18 includes a horizontal plate-shaped base member 120 fixed to the lower portion of the head 4, a moving member 121 slidably mounted on the underside of the base member 120 and a pivot arm 122 pivotally mounted on the underside of the moving member 121.

The thread guide threading mechanism 18 further includes a thread hook member 123 pivotally mounted on the underside of the moving member 121 and having a thread hook 123*a* formed on the distal end thereof. The hook member 123 is coupled to the pivot arm 122 so as to be rockable between a standby position (see FIGS. 24 and 28) where the needle thread 11 drawn from the thread cassette 10 is not caught on the thread hook 123*a* and an operating position (see FIGS. 25 and 29) where the needle thread 11 can be caught on the thread hook 123*a*. The thread guide threading mechanism 18 further includes an operating force applying member 124 (see FIGS. 28 and 29) for applying to the hook member 123 an operating force for switching the hook member 123 between the standby position and the operating position. The thread guide threading mechanism 18 further includes an operating force transmitting mechanism 125 for transmitting to the pivot arm 122 an operating force applied to the operating force applying member 124.

The thread guide threading mechanism 18 performs a first rocking switching the hook member 123 from a standby position to an operating position by an operating force the thread cassette 10 applies to the operating force applying member 124 in synchronization with attachment of the thread cassette. The thread guide threading mechanism 18 also performs a sliding movement in which the hook member 123 switched to the operating position and the pivot arm 122 are slid from the operating position together with the moving member 121 so that the first and second thread guides 19 and 20 are threaded. The thread guide threading mechanism 18 further performs a second rocking in which the hook member 123 is rocked to be returned to the standby position after the thread guides have been threaded.

The standby position includes a first standby position (see FIGS. 24 and 28) which is near the thread guides 19 and 20 before attachment of the thread cassette 10 and a second standby position (see FIGS. 27 and 31) which is farther from the thread guides 19 and 20 than the first standby position.

The base member 120 is suspended from two support members 131 and 132 (see FIG. 28) mounted on a frame member 130 constituting a part of the thread tensioning mechanism 14. The base member 120 has a stopper 133 integrally formed thereon so as to protrude downward. The stopper 133 receives the pivot arm 122 moving leftward during the sliding movement thereby to stop the arm.

The moving member 121 comprises a generally rectangular horizontal plate-shaped member and is mounted on two pin members 134 and 135 further mounted on the base member 120 so that the moving member is slid right and left. The moving member 121 is formed with a guide groove 121*a* extending in a right-and-left direction. The pin members 134 and 135 are engaged with each other so that the moving member 121 is slid relative to the base member 120. The guide groove 121*a* guides the sliding movement of the moving member 121. More specifically, the moving member 121 is mounted on the base member 120 so as to be slid by a predetermined distance between a first condition where the left pin member 134 is located at the left end of the guide groove 121*a* (see FIG. 24) and a second condition where the right pin 135 is located at the right end of the guide groove (see FIG. 27). The moving member 121 has a slit 121*b* formed in the rear of the guide groove 121*a* so as to be parallel to the guide groove. A return coil spring 136 is provided in the slit 121*b* to elastically urge the moving member 121 rightward (guide start end position in FIG. 24).

The pivot arm 122 has a proximal end which is pivotally mounted via a pin 137 (see FIG. 28) on the front right end of the moving member 121. A torsion spring 138 is provided around the pin 137 to elastically urge the pivot arm 122 counterclockwise in FIG. 24 (in the direction of standby position of the hook member 123). The pivot arm 122 has an operating force input portion 122*a* formed at a central right portion thereof. An operating force for switching the hook member 123 by the operating force transmitting mechanism 125 is supplied to the operating force input portion 122*a*. The pivot arm 122 has a distal end including a left-hand portion formed with a horizontally projecting abutment portion 122*b* which abuts against a stopper member 133 when the pivot arm 122 is slid by a predetermined distance together with the moving member 121 as will be described later.

Figure 24:
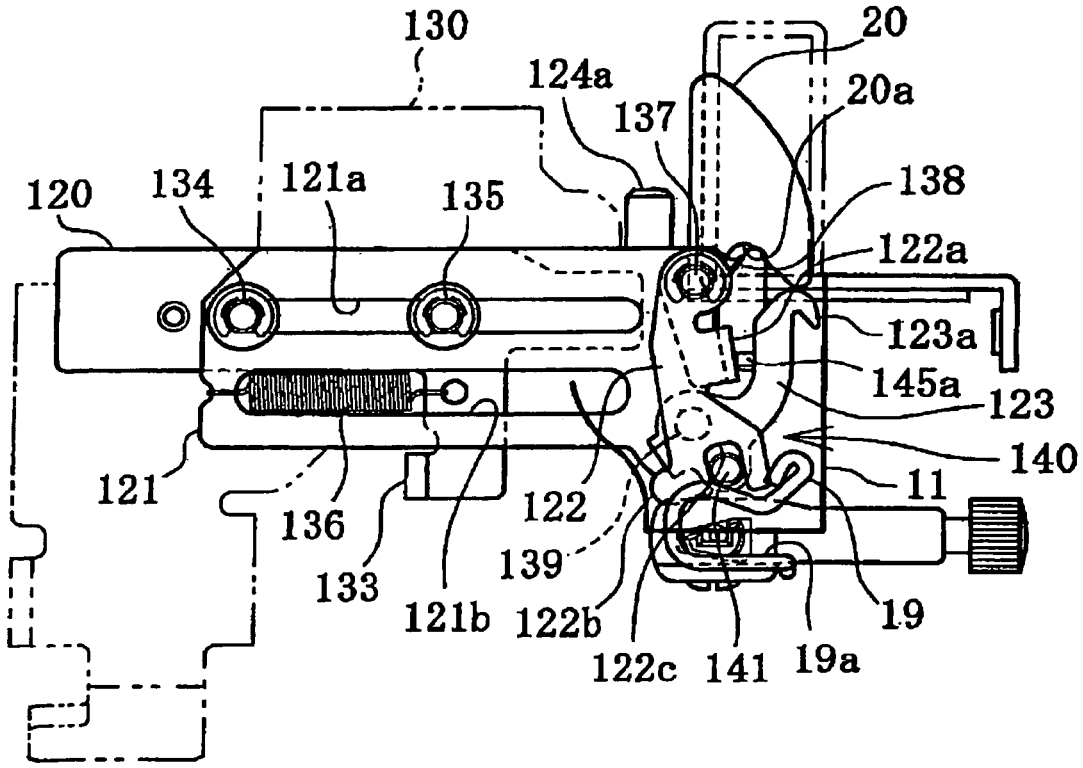
FIG. 24 is a bottom view of the threading mechanism under the condition immediately before the threading operation.
Figure 28:
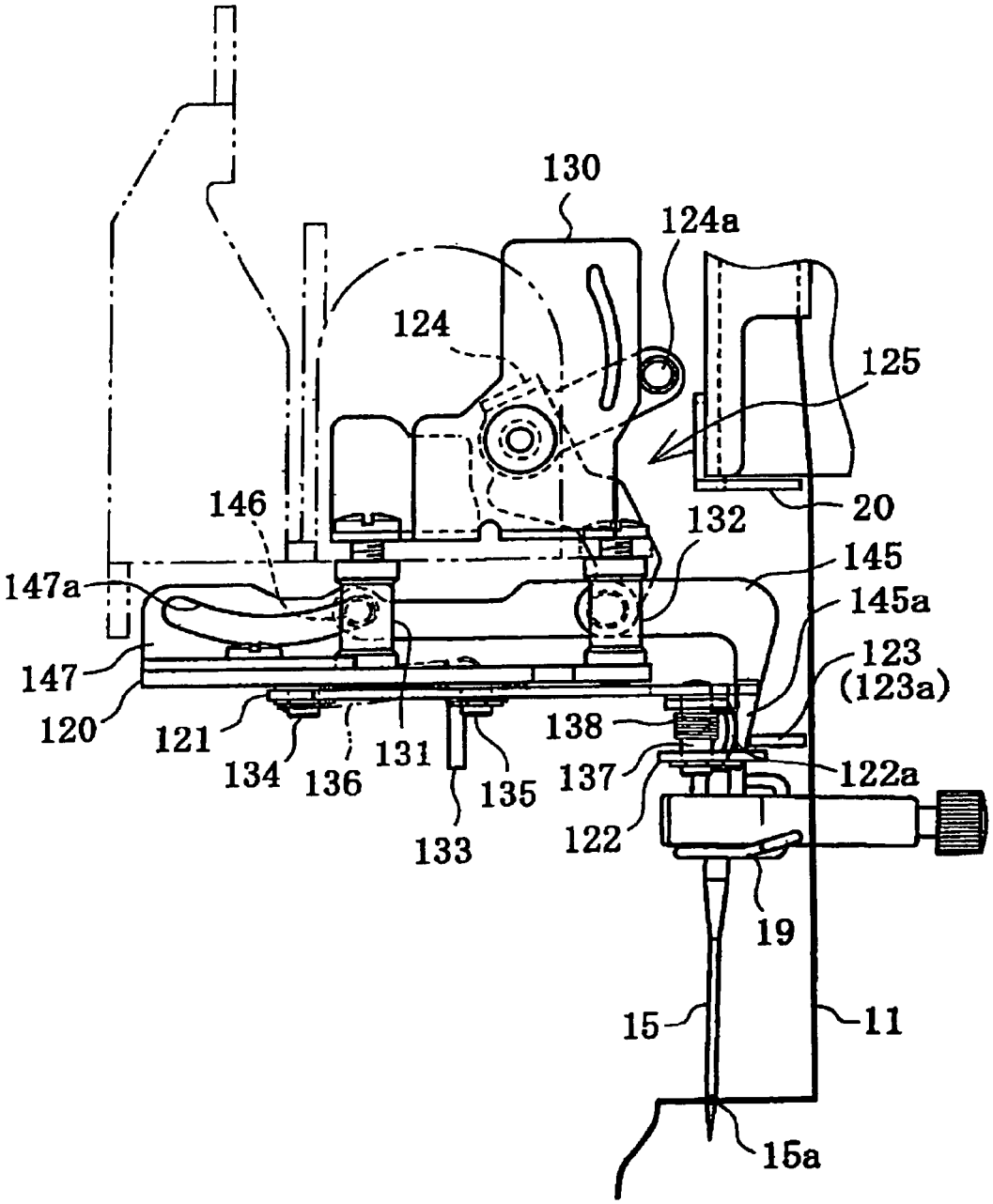
FIG. 28 is a front view of the threading mechanism under the condition as shown in FIG. 24.

The hook member 123 has a proximal end pivotally mounted via a pin 139 on the moving member 121. The distal end of the pivot arm 122 and a portion of the hook member 123 near the proximal end are interlocked by an interlock mechanism 140 which will be described later. Accordingly, the proximal ends of the hook member 123 and the pivot arm 122 are pivotally mounted on the moving member 121 so as to maintain a predetermined positional relation. The interlock mechanism 140 includes a notch 122*c* formed in the distal end of the pivot arm 122 and a pin 141 provided in the rear of the pin 139 near the proximal end of the hook member 123 so as to project downward and engage the notch 122*c*. The hook member 123 has a guide hook 123*a* which is away from the needle thread 11 when the hook member 123 is at the first standby position as shown in FIGS. 24 and 28. In this state, when the pivot arm 122 pivots clockwise in FIG. 25 about the pin 137 by a predetermined angle $\theta_1$ (for example, $\theta_1 \approx 20°$) against the urging force of the torsion spring 138, the notch 122*c* is also turned by the angle $\theta_1$. At this time, the pin 141 is turned about the pin 139 by the notch 122*c*.

Figure 25:
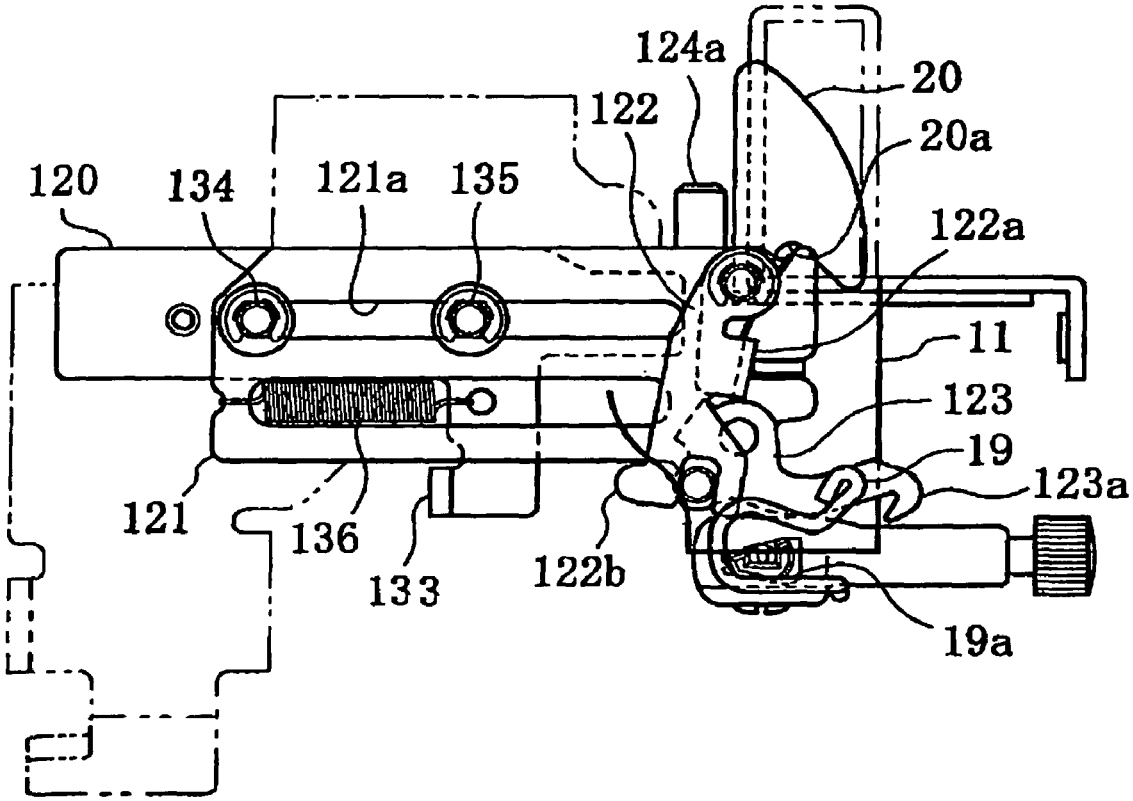
FIG. 25 is a bottom view of the threading mechanism under the condition after the first rocking motion.
Figure 29:
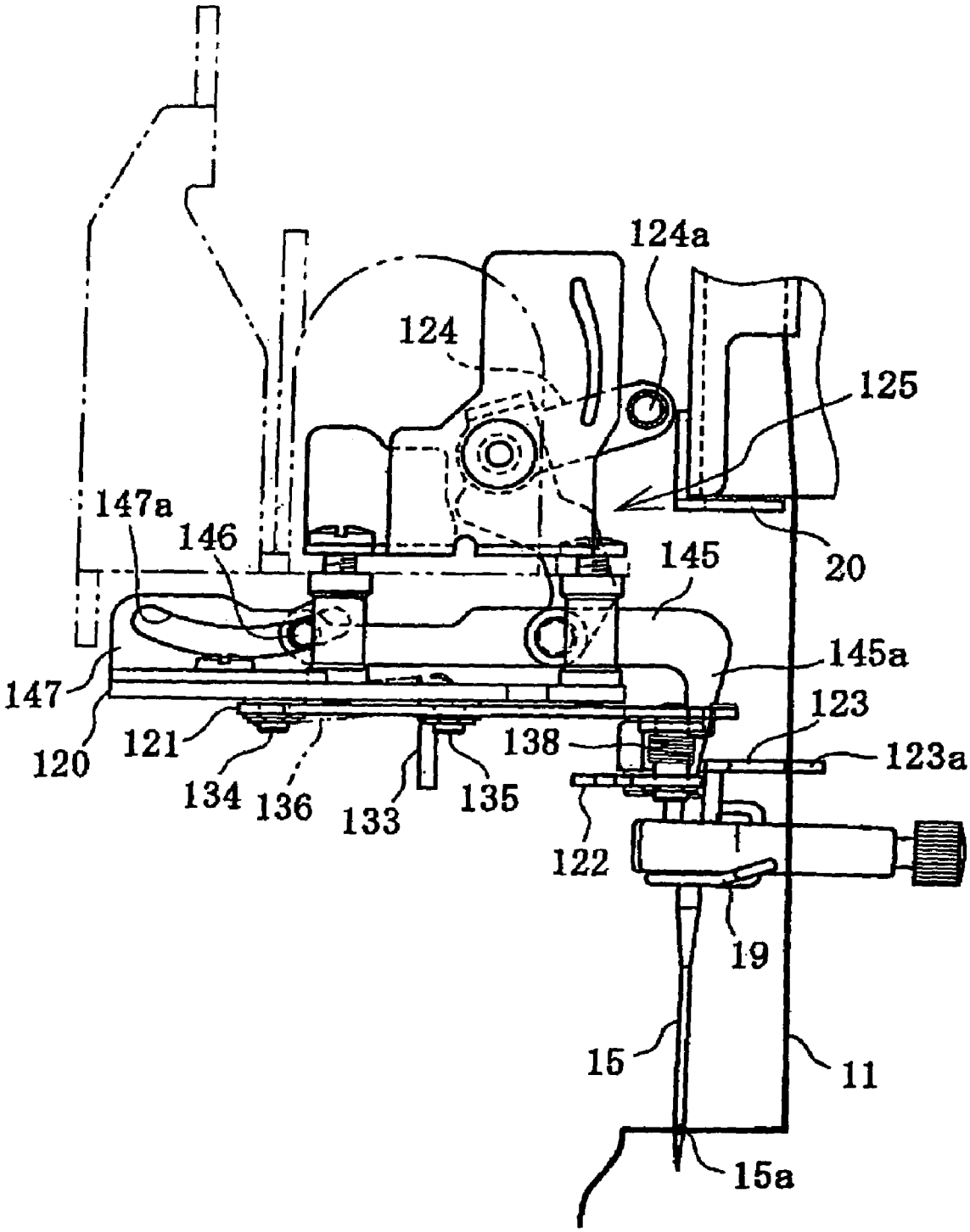
FIG. 29 is a front view of the threading mechanism under the condition as shown in FIG. 25.

The distance between the pins 137 and 141 is longer than the distance between the pins 139 and 141. Accordingly, when the hook member 123 is rocked in the horizontal state by the turning of the pin 141, the turning of the pin 141 is enlarged such that the guide hook 123*a* is rocked substantially horizontally clockwise in FIG. 25 about the pin 139 by a predetermined angle $\theta_2$ (for example, $\theta_2 \approx 90°$) which is larger than the pivot angle of the pivot arm 122. The hook member 123 reaches the operating position as shown in FIGS. 25 and 29, whereupon the guide hook 123*a* engages the needle thread 11. However, the hook member 123 is located below the pivot arm 122 and the moving member 121 and has an upwardly protruding portion (not shown) formed integrally therewith. The protruding portion is also turned with turn of the hook member 123. The moving member 121 partially overhangs a turning path of the protruding portion. When the hook member 123 pivots the predetermined angle $\theta_2$, the protruding portion of the hook member engages the overhang (not shown) of the moving member 121, whereupon a further pivot of the hook member 123 is prevented.

Referring to FIGS. 28 to 31, an operating force applying member 124 is pivotally mounted on a frame member 130 of the thread tensioning mechanism 14 so as to be rocked. The operating force applying member 124 has a forwardly projecting cassette contact 124*a* provided on the distal end side (right-hand end side) thereof. The lower end of the thread cassette 10 comes into contact with the cassette contact 124*a*. In attachment of the thread cassette 10, an operating force is transmitted from the thread cassette 10 to the cassette contact 124*a* in synchronization with attachment of the thread cassette so that the hook member 123 is switched between the standby position and the operating position. As a result, the operating force applying member 124 is rocked clockwise in FIG. 28.

An operating force transmitting mechanism 125 comprises a link member 145 pivotally mounted at its middle portion on the lower end of the operating force applying member 124, a distal end arm 145*a* formed on the distal end (right-hand end) of the link member 145 so as to be bent downward, a driven pin 146 provided on the proximal end (left-hand end) of the link member 145, and a cam plate 147 having an arc cam groove 147*a* the driven pin 146 engages. The link member 145 extends in the right-and-left direction and is moved in the right-and-left direction. When the operating force is applied from the thread cassette 10 to the cassette contact 124*a*, the operating force applying member 124 is rocked clockwise in FIG. 28. The link member 145 is moved leftward with the rocking of the operating force applying member 124. As described above, the moving member 121 is urged rightward by the coil spring 136. Since the pivot arm 122 is pivotally mounted on the moving member 121, the lower end of the distal end arm portion 140*a* is usually in abutment with the operating force input portion 122*a* of the pivot arm 122.

More specifically, the operating force is transmitted through the link member 145 extending in the right-and-left direction to the operating force input portion 122*a* of the pivot arm 122. Since the proximal end of the link member 145 is guided via the driven pin 146 along the cam groove 147*a* of the cam plate 147, the driven pin 146 is moved in an arc of the cam groove 147*a* substantially corresponding with an arc in which the lower end of the operating force applying member 124 is moved. Consequently, the overall link member 145 can smoothly be moved in the right-and-left direction. In other words, the link member 145 has no center of rotation when it is rotated. Accordingly, the distal end arm portion 145*a* presses the operating force input portion 122*a* substantially horizontally leftward, whereupon sliding friction can be prevented from occurring between the distal end arm 145*a* and the operating force input portion 122*a*.

A threading operation carried out by the thread guide threading mechanism 18 will now be described. Before attachment of the thread cassette, as shown in FIGS. 24 and 28, the hook member 123 is at the first standby position where the needle thread 11 is not caught on the threading hook 123*a*. In this state, when the thread cassette 10 is pushed into the cassette mount 5, the lower end of the cassette body 20 abuts against the cassette contact 124*a* such that the thread cassette applies an operating force to the cassette contact 124*a* thereby to rock the cassette contact clockwise in FIG. 28. At this time, when the operating force is transmitted from the operating force applying member 124 via the distal end arm portion 145*a* of the link member 145 to the operating force input portion of the pivot arm 122, a first rocking movement is carried out in which the pivot arm 122 is turned by the predetermined angle $\theta_1$ and the hook member 123 is switched from the standby position to the operating position.

More specifically, the operating force supplied to the operating force input portion 122*a* turns the pivot arm 122 about the pin 137 by the predetermined angle $\theta_1$ clockwise in FIG. 24. As a result, the hook member 123 is also rocked about the pin 139 clockwise in FIG. 24 between the first and second thread guides 19 and 20 by the interlock mechanism 140. The threading hook 123*a* is turned by the predetermined angle $\theta_2$ thereby to be switched to the operating position as shown in FIG. 25, engaging the needle thread 11. In order that the needle thread 11 may reliably be caught by the threading hook 123*a*, the operating position of the hook member 123 as shown in FIG. 25 is located rightward (opening direction of the thread guide portions 19*a* and 20*a*) relative to the first standby position as shown in FIG. 24. With turn of the pivot arm 122, the abutment portion 122*b* formed in the distal end of the pivot arm 122 projects leftward.

Figure 26:
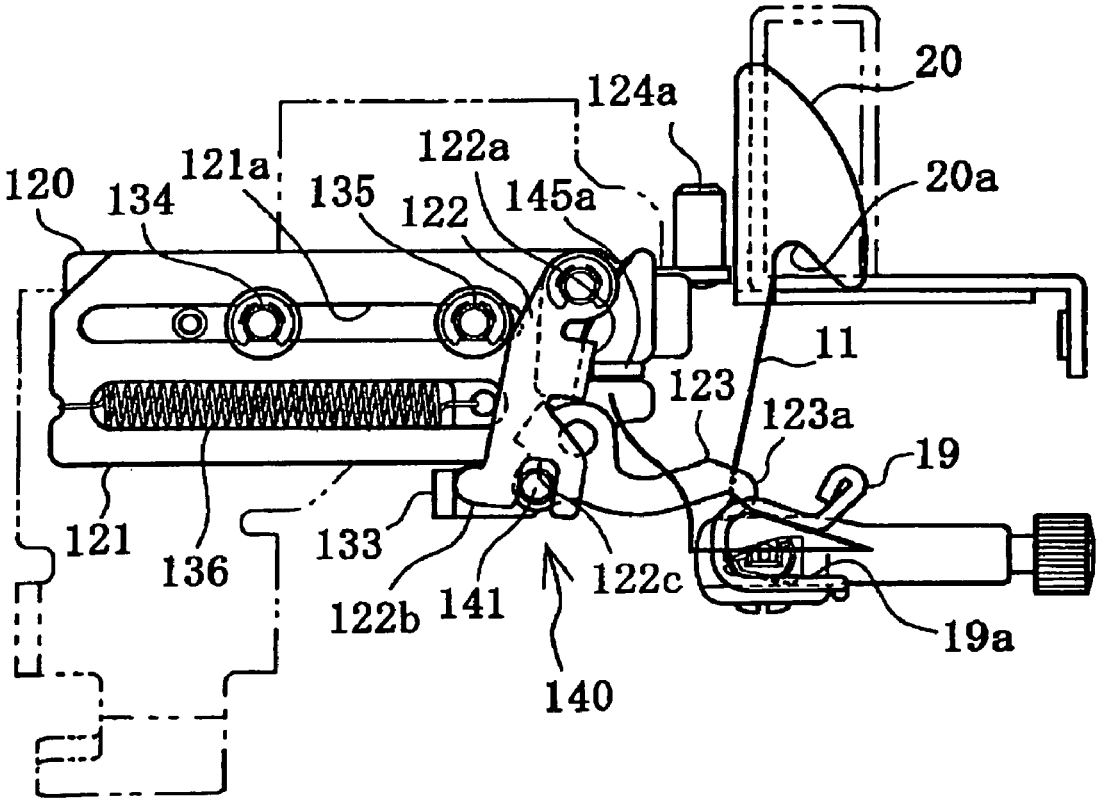
FIG. 26 is also a bottom view of the threading mechanism under the condition after the sliding motion.
Figure 30:
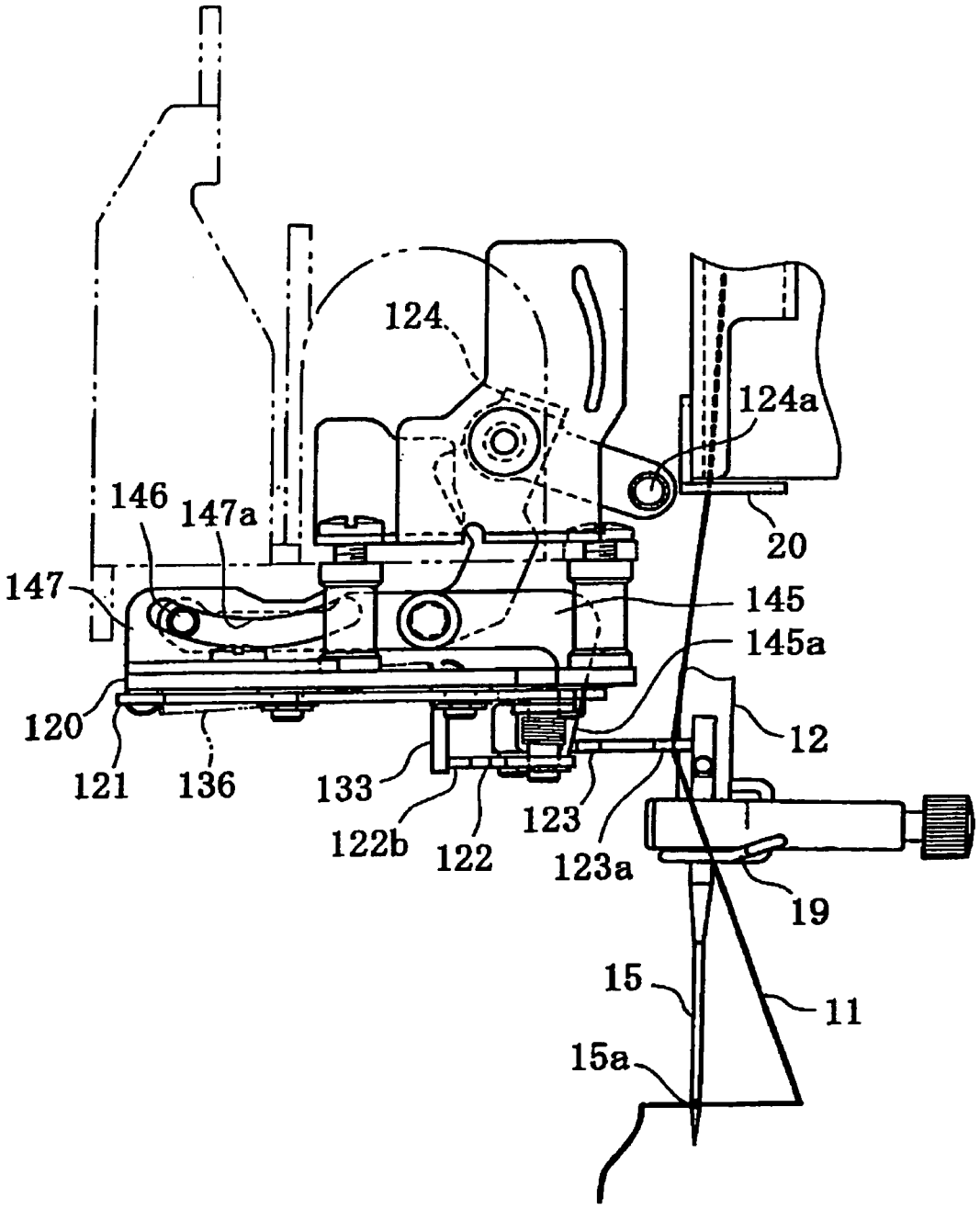
FIG. 30 is a front view of the threading mechanism under the condition as shown in FIG. 26.

When the operating force is further transmitted to the pivot arm 122 after the first rocking movement, further turn exceeding the predetermined angle $\theta_1$ is prevented by the engagement of the overhang of the moving member 121 and the projecting portion of the hook member 123. Accordingly, as shown in FIGS. 26 and 30, the hook member 123 switched to the operating position and the pivot arm 122 are slid leftward a predetermined distance together with the moving member 121 against the urging force of the coil spring 136 until the abutment portion 122*b* abuts against the stopper member 133. In the sliding movement, the needle thread 11 engaging the threading hook 123*a* is drawn leftward together with the hook member 123 such that the needle thread is caught on the threading portions 19*a* and 20*a* of the first and second thread guides 19 and 20 respectively.

The threading portions 19*a* and 20*a* of the respective thread guides 19 and 20 are open substantially rightward as shown in FIGS. 24 to 27. The hook member 123 is moved between the standby position and the operating position which are further between the two thread guides 19 and 20. Accordingly, the needle thread 11 engaging the threading hook 123*a* is reliably caught on the thread guides 19 and 20 by the sliding movement. Furthermore, the needle thread 11 engaging the threading hook 123*a* is moved from the open ends (right ends) of the threading portions 19*a* and 20*a* of the thread guides 19 and 20 to the inner ends (left ends), whereupon the needle thread 11 is reliably caught on the inner ends of thread guides 19 and 20.

Referring to FIGS. 26 and 30, when the abutment 122*b* abuts against the stopper member 133, the pin 141 is unable to move leftward (a part of the pivot arm 122 is temporarily stopped relative to the moving member 121). In this state, when the thread cassette 10 is further thrust into the cassette mount such that an operating force is further supplied to the input portion 122*a*, the second rocking movement is carried out to return the hook member 123 to the stand by position. More specifically, the moving member 121 is moved leftward relative to the base member 120 until the right-hand pin 135 engages the right end of the guide groove 121*a*. Accordingly, the pivot arm 122 is caused to pivot about the pin 141 counterclockwise in FIG. 27. The interlock mechanism 140 is operated by the pivot of the arm 122 so that the hook member 123 is rocked about the pin 141 counterclockwise in FIG. 27 thereby to be switched to the second standby position.

The abutment 122*b* is slid on the stopper member 133 with pivot of the arm 122. On this occasion, the needle thread 11 is disengaged from the threading hook 123*a* to be detached from the hook, whereupon catching the needle thread 11 on the thread guides 19 and 20 is completed. When the hook member 123 is switched to the second standby position, the threading hook 123*a* is located farther away from the needle bar 12 and needle thread 11 than when the hook member 123 is at the first standby position.

The sequential operation of the sewing machine M in the attachment of the thread cassette 10 will now be described with main concern to the threading operation of the threading mechanism 16, thread holding operation of the thread holding mechanism 17 and thread guiding operation of the thread guide mechanism 18. When the thread cassette 10 is inserted into the cassette mount 5 from above, the lower end of the cassette body 30 thrusts the cassette contact 90 downward as shown in FIGS. 14 to 19. As a result, the interlock mechanism 73 is operated so that the holding member 70 is moved downward in synchronization with attachment of the thread cassette 10. When reaching the pin passage 112 inside the cam member 42 of the thread cassette 10, the driven pin 84 provided on the thread nipping member 74 is moved downward along the cam face 111*a*. Consequently, the driven pin 84 is operated by the cam member 42 so that the thread nipping member 74 is rocked about the pivot shaft 82 to the releasing side against the urging force of the torsion spring 75.

The thread nipping member 74 is rocked to the maximum releasing side when the holding member 70 is moved downward such that the driven pin 84 abuts against the rearmost projecting portion of the cam face 111*a* as shown in FIG. 17. At this time, the portion 11*c* (FIGS. 4 and 7) of the needle thread 11 extending along the front of the thread cassette 10 enters the space between the left thread holding portion 71 and the thread nipping member 74. Thereafter, when the driven pin 84 is moved downward along the cam face 111*a*, the thread nipping member 74 is rocked to the holding side by the torsion spring 75. When the driven pin 84 gets out of the pin passage 112 to be completely detached from the cam face 111*a*, the needle thread 11 is held between the holding member 71 and the thread nipping member 74 as shown in FIG. 18. In this state, the moving frame 77 and the holding member 70 are further moved downward with attachment of the thread cassette 10, so that the needle thread 11 is held near the needle eye 15*a* by the paired thread holding portions 71 and 72 of the holding member 70.

The threading operation is also carried out by the threading mechanism 16 synchronously. More specifically, the threading shaft 50, slider guide 51 and threading slider 52 are moved downward in synchronization with attachment of the thread cassette 10, as shown in FIG. 8. When moved downward a predetermined distance, the threading shaft 50 is prevented from further downward movement by the pin member 56 and limiting member 12*c*. However, the threading slider 52 is further moved downward against the urging force of the coil spring 58. Thus, the threading slider 52 is further moved downward relative to the threading shaft 50. The relative movement of the threading slider 52 is converted to turn of the threading shaft 50 by the pin member 56*a* and cam groove 52*a* of the threading slider 52, whereby the threading shaft 50 is turned by a predetermined angle.

The hook mechanism 53 provided on the lower end of the threading shaft 50 is also turned with the threading shaft as shown in FIG. 20. As a result, the hook portion 60*a* of the threading hook 60 is passed through the needle eye 15*a*. At this time, the holding member 70 of the thread holding mechanism 17 starts to move upward from the lowermost position, so that the needle thread 11 held by the thread holding portions 71 and 72 is caught by the hook 60*a*. At this time, the cam portion 54*b* of the threading shaft driving member 54 abuts against the distal end cam portion 69*a* of the cam member 69 so that the threading shaft driving member 54 is driven counterclockwise in FIG. 8 against the urging force of the torsion spring 67. Accordingly, since the drive force for driving the shaft 50 downward is not transmitted to the threading slider 52, the shaft 50 is turned in the opposite direction and returned upward by the urging force of the coil spring 58. With this, the hook mechanism 53 is turned together with the shaft 50, whereupon the hook member 123 on which the needle thread 11 is caught is returned through the needle eye 15*a* as shown in FIG. 21. Thus, the threading operation is completed.

Thus, when the thread cassette 10 is further pushed into the cassette mount 5 with the needle thread 11 having been passed through the needle eye 15*a*, the needle thread is caught on the two thread guides 19 and 20 by the threading mechanism 18. More specifically, as shown in FIGS. 24 and 28, the lower end of the cassette body 30 abuts against the cassette contact 124*a* of the operating force applying member 124 when the thread cassette 10 is thrust into the cassette mount 5 under the condition where the hook member 123 is at the first standby position where the needle thread 11 is not caught on the threading hook 123*a*. Consequently, the operating force from the thread cassette 10 is applied to the cassette contact 124*a*.

Figure 27:
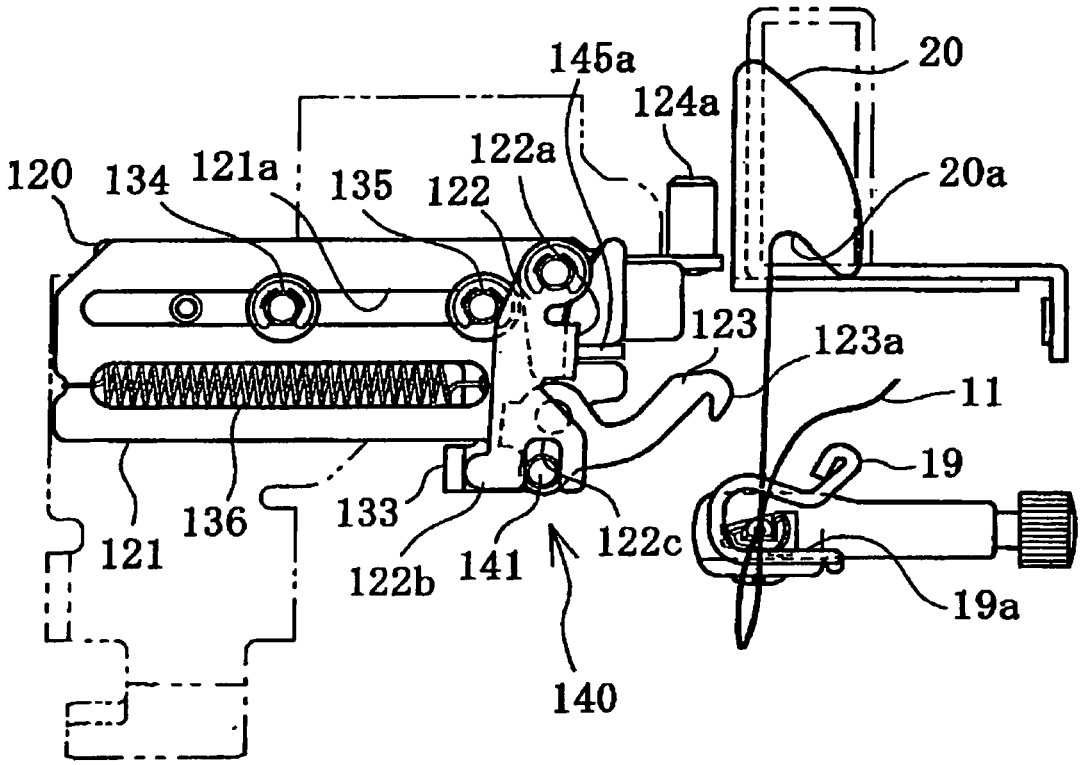
FIG. 27 is a bottom view of the threading mechanism under the condition after the second rocking motion.
Figure 31:
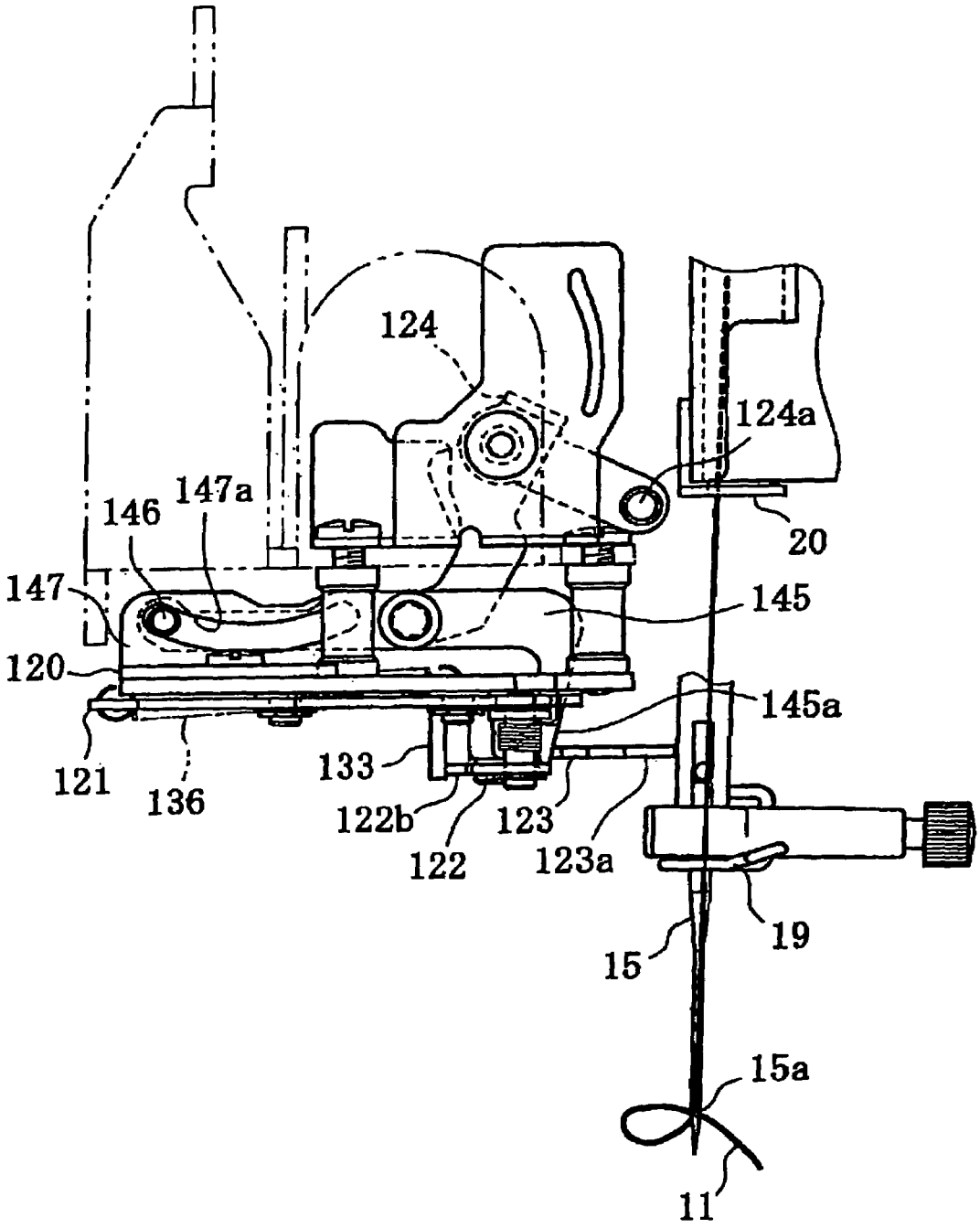
FIG. 31 is a front view of the threading mechanism under the condition as shown in FIG. 27.

The operating force applied to the operating force applying member 124 is transmitted to the input portion 122*a* of the pivot arm 122 by the operating force transmitting mechanism 125. Then, the first rocking movement is carried out in which the hook member 123 is switched from the first standby position to the second standby position so that the needle thread 11 engages the threading hook 123*a*, as shown in FIGS. 25 and 29. The sliding movement is then carried out in which the hook member 123 switched to the operating position and the pivot arm 122 are slid together with the moving member 121, as shown in FIGS. 26 and 30, whereupon the needle thread 11 is caught by the thread catching portions 19*a* and 20*a* of the thread guides 19 and 20. Furthermore, the second rocking movement is carried out in which the hook member 123 is returned to the second standby position after the needle thread has been caught by the thread guides 19 and 20, as shown in FIGS. 27 and 31. Consequently, the needle thread 11 is disengaged from the threading hook 123*a* and the threading operation is completed.

The following effects can be achieved from the above-described sewing machine M. The thread guide threading mechanism 18 switches the hook member 123 between the standby position and the operating position by the operating force the thread cassette 10 applied to the operating force applying member 124 in synchronization with attachment of the thread cassette, thereby catching the needle thread 11 on the first thread guide 19. Consequently, the needle thread can automatically be caught on the first thread guide 19 in synchronization with attachment of the thread cassette to the cassette mount.

The needle bar 12 is located at a position near the uppermost position after the needle thread has been passed through the needle eye 15*a*. The first thread guide 19 is located beneath the head 4 so as to be close to the head. Accordingly, it is difficult for the user to thread the first guide 19 when the sewing machine is threaded or when cloth is put into and taken out of the sewing machine. In the foregoing embodiment, however, the needle thread 11 can be caught on the first thread guide 19 in synchronization with attachment of the thread cassette 10. Consequently, the aforesaid troublesome work can be eliminated and the working efficiency can be improved. Furthermore, the needle thread 11 can also be caught on the second thread guide 20 when caught on the first thread guide 19.

The proximal end of the link member 145 is guided via the driven pin 146 along the cam groove 147*a*. Accordingly, the operating force is transmitted via the link member 145 to the operating force input portion 122*a* of the pivot arm 122 in synchronization with attachment of the thread cassette 10. On this occasion, the link member 145 can smoothly be moved in the right-and-left direction horizontally. Accordingly, the distal end arm portion 145*a* can press the input portion 122*a* of the pivot arm 122 substantially horizontally rightward. Consequently, occurrence of sliding friction can be prevented between the distal end arm portion 145*a* and the input portion 122*a*. In other words, a force required to attach the thread cassette can be rendered smaller.

The thread catching portions 19*a* and 20*a* of the thread guides 19 and 20 are open substantially in the same direction (rightward). The operating position of the hook member 123 is located so as to be directed to the opening direction of the thread catching portions 19*a* and 20*a* as compared with the standby position thereof. Between the thread guides 19 and 20, the hook member 123 is moved between the standby and operating positions. Accordingly, the needle thread 11 can be prevented from being caught on the threading hook 123*a* when the hook member 123 is at the standby position. When the hook member 123 is switched to the operating position, the thread catching portions 19*a* and 20*a* can catch the needle thread 11 located in the opening direction of thread catching portions 19 and 20.

Furthermore, between the first and second thread guides 19 and 20, the hook member 123 is moved between the standby and operating positions as described above. Accordingly, the hook member 123 is moved to the side opposed to the opening direction of the thread catching portions 19*a* and 20*a* while the needle thread 11 is caught by the threading hook 123*a*. Consequently, since the needle thread 11 goes into the inner ends of the thread catching portions 19*a* and 20*a*, the needle thread 11 can reliably be caught on the first and second thread guides 19 and 20.

When the operating force is transmitted via the transmitting mechanism 125 to the input portion 122*a* of the pivot arm 122, the needle thread 11 is engaged with the thread catching hook 123*a* by the first rocking movement. The needle thread 11 in engagement with the hook 123*a* is drawn toward the thread guides 19 and 20 by the sliding movement, thereby being caught on the thread guides. Finally, the needle thread 11 is disengaged from the hook 123*a* by the second rocking movement. Thus, the needle thread 11 can automatically be caught on the thread guides 19 and 20 reliably. Furthermore, in the sliding movement (second movement), the needle thread 11 in engagement with the hook 123*a* is moved from the open ends of the threading portions 19*a* and 20*a* toward the inner end side. Consequently, the needle thread 11 can reliably be caught on the inner ends of the thread guides 19 and 20.

The hook member 123 is located at the first standby position near the thread guides 19 and 20 when the thread cassette 10 is not attached to the cassette mount 5. Upon attachment of the thread cassette 10, the hook member 123 is switched from the first standby position to the operating position. Consequently, threading the thread guides 19 and 20 can quickly be initiated. On the other hand, upon completion of the attachment of the thread cassette 10, the hook member 123 is located at the second standby position farther away from the thread guides 19 and 20 than the first standby position. Since the hook member 123 is located away from the needle bar 12, the needle thread 11 can be prevented from being stuck to the hook member 123.

The cassette mount 5 is provided in the head 4 of the sewing machine M. The thread cassette 10 is attached to the cassette mount 5 from above the sewing machine M. When the user pushes the thread cassette 10 with both hands to attach it to the cassette mount 5, the hands of the user are located over the head 4. In other words, the user's hands are located away from the thread guides 19 and 20 which are provided below the head 4. In the foregoing embodiment, however, the needle thread 11 is caught on the thread guides 19 and 20 in synchronization with attachment of the thread cassette 10. Accordingly, the user need not pass his or her hands from above the head 4 to the thread guides 19 and 20 after the thread cassette 10 has been attached to the cassette mount 5. Consequently, the preparation for the sewing work can smoothly be carried out.

Several modified forms will be described. The supply of thread includes a thread spool and bobbin in the foregoing embodiment. However, various types of thread supply may be used. For example, a mere mass of thread may be used. Furthermore, the thread cassette may be constructed so that the thread spool or mass of thread is exposed and mounted on the spool pin.

In the foregoing embodiment, the user thrusts the thread cassette into the cassette mount 5 with his or her hand or hands other driving means such as rubber rollers or an electric motor may be used so that the thread cassette 10 is automatically be attached to the cassette mount 5. The aforesaid drive means may be used to drive the thread holding mechanism 17 and the thread guide mechanism 18. Furthermore, when the needle thread is caught on the two thread guides 19 and 20, the thread holding mechanism 17 and the thread guide mechanism 18 may be driven by a manually operated lever.

The thread guides 19 and 20 are open rightward and have horizontally formed thread catching portions 19*a* and 20*a* in the foregoing embodiment. The hook member 123 is moved substantially horizontally between the standby position and the operating position, whereby the needle thread 11 is caught on the catching hook 123*a*. However, the hook member 123*a* may be moved from the right to the left obliquely downward at 45 degrees. On the other hand, the thread catching portions 19*a* and 20*a* of the thread guides 19 and 20 may be open rightward and may extend obliquely upward substantially at 45 degrees so that the hook member 123 is moved horizontally from the left to the right.

The base member of the thread guide mechanism may be integral with a sewing machine frame or a cover covering the sewing machine frame. In this case, the moving member, stopper member, stopper member or coil spring is provided directly on the sewing machine frame or a cover covering the sewing machine frame.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A thread guide threading apparatus threading a thread guide provided in a lower part of a sewing machine head, the apparatus comprising:

a moving member mounted on the sewing machine head so as to be slid;

a pivot arm pivotally mounted on the moving member so as to be caused to pivot and so as to slide the moving member when an operating force is applied thereto; and a hook member pivotally mounted on the moving member and coupled to the pivot arm so as to operated in synchronization with the pivot arm, the hook member having a threading hook, the hook member performing a first rocking switching the hook member from a standby position where the threading hook is not threaded to an operating position, based on action of an operating force upon pivoting of the pivot arm, the hook member further performing a sliding movement in which the hook member is slid from the operating position together with the pivot arm and the moving member to thread the thread guide and a second rocking in which the hook member is rocked to be returned to the standby position after having threaded the thread guide.

2. A thread guide threading apparatus according to claim 1, wherein the moving member is slid a predetermined distance.

3. A thread guide threading apparatus according to claim 1, wherein the pivot arm has a proximal end pivotally mounted on the moving member, the hook member has a proximal end pivotally mounted on the moving member, the threading hook disengages from the thread when the hook member is located at the standby position, and the threading hook engages the thread when the hook member is located at the operating position.

4. A thread guide threading apparatus according to claim 1, wherein the pivot arm has a distal end and the hook member has a proximal end, the apparatus further comprising an interlocking mechanism interlocking the distal end of the pivot arm and a portion of the hook member near the proximal end and a pivot urging member elastically urging the pivot arm so that the hook member is directed to the standby position.

5. A thread guide threading apparatus according to claim 4, further comprising a stopper receiving pivot arm immediately before end of the sliding movement of the moving member, thereby stopping the pivot arm, wherein the hook member is switchable from the operating position to the standby position by the sliding movement after the pivot arm has been received by the stopper.

6. A thread guide threading apparatus according to claim 5, further comprising an urging member elastically urging the moving member toward a position where the threading starts.

7. A thread guide threading apparatus according to claim 6, further comprising a base member fixed to the sewing machine head, wherein at least any one of the moving member, the stopper and the urging member is mounted on the base member.

8. A thread guide threading apparatus according to claim 1, wherein the sewing machine head is provided with a cassette mount to which a thread cassette accommodating a supply of thread is attached, the hook member is located at a first standby position when the thread cassette is not attached to the cassette mount, and the hook member is located at a second standby position farther away from the thread guide than the first standby position when the thread cassette is attached to the cassette mount.

9. A thread guide threading apparatus threading a thread guide provided in a lower part of a sewing machine head and having an open end an inner end, the apparatus comprising:

an operating force applying member applying an external operating force; and a hook member having a threading hook and moved by the operating force applied by the operating force applying member between a standby position where the threading hook is not threaded and an operating position where the threading hook can be threaded, the movement of the hook member including a first movement in which the hook member is switched from the standby position to the operating position, a second movement in which the hook member is moved a predetermined distance so that the thread caught on the threading hook by the first movement is moved from the open end of the thread guide to the inner end side of the thread guide, and a third movement in which the hook member is switched from the operating position to the standby position.

10. A sewing machine comprising:

a sewing machine head;

a thread guide provided in a lower part of the sewing machine head; and a threading apparatus threading the thread guide and comprising:

a moving member mounted on the sewing machine head so as to be slid;

a pivot arm pivotally mounted on the moving member so as to be pivoted and so as to slide the moving member when an operating force is applied thereto; and a hook member pivotally mounted on the moving member and coupled to the pivot arm so as to operated in synchronization with the pivot arm, the hook member having a threading hook, the hook member performing a first rocking operation switching the hook member from a standby position where the threading hook is not threaded to an operating position, based on action of an operating force upon rotation of the pivot arm, the hook member further performing a sliding movement in which the hook member is slid from the operating position together with the pivot arm and the moving member to thread the thread guide and a second rocking operation in which the hook member is rocked to be returned to the standby position after having threaded the thread guide.

11. A sewing machine comprising:

a sewing machine head;

a thread guide provided in a lower part of the sewing machine head; and a threading apparatus threading the thread guide and comprising:

an operating force applying member applying an external operating force;

a hook member moved by the operating force applied to the operating force applying member between a standby position where the threading hook is not threaded and an operating position where the threading hook is allowed to be threaded, the movement of the hook member including a first movement in which the hook member is switched from the standby position to the operating position, a second movement in which the hook member is moved a predetermined distance so that the thread caught on the threading hook by the first movement is moved from the open end of the thread guide to the inner end side of the thread guide, and a third movement in which the hook member is switched from the operating position to the standby position.

12. A thread guide threading apparatus for use in a sewing machine which includes a thread cassette detachably attached to a cassette mount and a thread guide provided below a needle bar supporting a sewing needle, the threading apparatus comprising:

a hook member having a threading hook and moved between a standby position where the thread drawn from the thread cassette is not caught on the threading hook and an operating position where the threading hook is allowed to be threaded, the hook member being switched between the standby position and the operating position, whereby the thread is caught on the thread guide; and an operating force applying member applying an operating force for switching the hook member between the standby position and the operating position in synchronization with attachment of the thread cassette.

13. A thread guide threading apparatus according to claim 12, further comprising another thread guide provided away from the first thread guide a predetermined distance, wherein the hook member threads both thread guides.

14. A thread guide threading apparatus according to claim 12, wherein the thread guide is disposed below the sewing machine head, the apparatus further comprising a base member fixed to a lower portion of the sewing machine head, a moving member slidably mounted on the base member, a pivot arm pivotally mounted on the moving member, and an operating force transmitting mechanism, wherein the pivot arm is coupled with the hook member and has an operating force input portion, and the operating force transmitting mechanism transmits the operating force acting on the operating force applying member to the operating force input portion of the pivot arm.

15. A thread guide threading apparatus according to claim 14, wherein the operating force transmitting mechanism includes a link member having a middle portion pivotally mounted on the operating force applying member, the link member having a proximal end and a distal end, a distal end arm formed on the distal end of the link member so as to bend downward, a driven pin mounted on the proximal end of the link member and a cam plate including a cam plate having an arc cam groove with which the driven pin is engaged.

16. A thread guide threading apparatus according to claim 14, wherein, when the thread cassette is attached to the cassette mount, the link member is moved substantially horizontally while the distal end arm thereof is in abutment with the operating force input portion, whereby the pivot arm is pivoted substantially horizontally; by pivot of the pivot arm, the hook member performing a first rocking to switch from a standby position to an operating position, the link member thereafter being moved substantially horizontally so that the hook member, pivot arm, and moving member are slid from the operating position, whereby the hook member performs a sliding movement to thread the thread guide; and the hook member performs a second rocking in which the hook member is rocked to be returned to the standby position after having threaded the thread guide.

17. A thread guide threading apparatus for use in a sewing machine which includes a first thread guide provided at a lower portion of a needle bar supporting a sewing needle and a second thread guide away from the first thread guide by a predetermined distance, the apparatus comprising:

a hook member having a threading hook and being moved between a standby position where the threading hook is not threaded and an operating position where the threading hook is allowed to be threaded, the hook member being switched between the standby position and the operating position thereby to thread the first and second thread guides; and an operating force applying member applying an operating force for switching the hook member between the standby position and the operating position.

18. A thread guide threading apparatus according to claim 17, wherein the first and second thread guides have threading portions having openings directed to the same direction, the operating position of the hook member is located nearer to the openings of the threading portions than the standby position of the hook member is, respectively, the hook member is moved between the standby position and the operating position both of which are further located between the first and second thread guides.

19. A sewing machine comprising:

a cassette mount;

a thread cassette accommodating a supply of thread and detachably attached to the cassette mount;

a needle bar supporting a sewing needle;

a first thread guide located in a lower portion of the needle bar;

a threading apparatus for threading the first thread guide, the threading apparatus comprising:

a hook member having a threading hook and moved between a standby position where a thread drawn from the thread cassette is not caught on the threading hook an operating position where the threading hook is allowed to be threaded, the hook member being switched between the standby position and the operating position thereby to thread the first thread guide; and an operating force applying member applying an operating force for switching the hook member between the standby position and the operating position from the thread cassette when the thread cassette is attached to the cassette mount.

20. A sewing machine comprising:

a needle bar supporting a sewing needle;

a first thread guide located in a lower portion of the needle bar;

a second thread guide located away from the first thread guide by a predetermined distance;

a threading apparatus for threading the first and second thread guides, the threading apparatus comprising:

a hook member having a threading hook and moved between a standby position where a thread drawn from the thread cassette is not caught on the threading hook an operating position where the threading hook is allowed to be threaded, the hook member being switched between the standby position and the operating position thereby to thread the first and second thread guide; and an operating force applying member applying an operating force for switching the hook member between the standby position and the operating position from the thread cassette when the thread cassette is attached to the cassette mount.

* * * * *

UNITED STATES PATENT AND TRADEMARK OFFICE

CERTIFICATE OF CORRECTION

PATENT NO. : 6,957,617 B2
DATED : October 25, 2005
INVENTOR(S) : Masayuki Hori

It is certified that error appears in the above-identified patent and that said Letters Patent is hereby corrected as shown below:

Title page,
Item [*], Notice: delete "Subject to any disclaimer, the term of this patent is extended or adjusted under 35 U.S.C. 1.54(b) by 165 days .".

and replace with:
-- Subject to any disclaimer, the term of this patent is extended or adjusted under 35 U.S.C. 1.54(b) by 265 days. --.

Signed and Sealed this

Twenty-first Day of March, 2006

JON W. DUDAS
*Director of the United States Patent and Trademark Office*